US010984711B2

(12) United States Patent
Lai et al.

(10) Patent No.: US 10,984,711 B2
(45) Date of Patent: Apr. 20, 2021

(54) PIXEL DRIVING CIRCUIT, DISPLAY PANEL AND DRIVING METHOD

(71) Applicant: Xiamen Tianma Micro-Electronics Co., Ltd., Xiamen (CN)

(72) Inventors: Qingjun Lai, Xiamen (CN); Yihua Zhu, Xiamen (CN)

(73) Assignee: XIAMEN TIANMA MICRO-ELECTRONICS CO., LTD., Xiamen (CN)

( * ) Notice: Subject to any disclaimer, the term of this patent is extended or adjusted under 35 U.S.C. 154(b) by 0 days.

(21) Appl. No.: 16/879,741

(22) Filed: May 20, 2020

(65) Prior Publication Data

US 2020/0286425 A1 Sep. 10, 2020

(30) Foreign Application Priority Data

Feb. 28, 2020 (CN) ..... 202010129869.1

(51) Int. Cl.
*G09G 3/3225* (2016.01)

(52) U.S. Cl.
CPC ... *G09G 3/3225* (2013.01); *G09G 2320/0271* (2013.01); *G09G 2320/0626* (2013.01)

(58) Field of Classification Search
CPC ..... G09G 2320/045; G09G 2320/0633; G09G 3/2011; G09G 2300/043; G09G 2320/0242; G09G 3/3225
See application file for complete search history.

(56) References Cited

U.S. PATENT DOCUMENTS

2019/0371231 A1* 12/2019 Kim ..... G09G 3/2011
2020/0111404 A1* 4/2020 Kim ..... G09G 3/2003

FOREIGN PATENT DOCUMENTS

CN 109979378 A 7/2019
CN 110491335 A 11/2019

* cited by examiner

*Primary Examiner* — Gerald Johnson
(74) *Attorney, Agent, or Firm* — Kilpatrick Townsend & Stockton, LLP

(57) ABSTRACT

Provided are a pixel driving circuit, a display panel and a driving method, the pixel driving circuit includes a first initialization device, a first threshold compensation device, a first data writing device, a first light emitting control device and a light emitting adjustment device. The first initialization device includes a first initialization signal terminal, a first initialization control terminal and a first scanning signal terminal, and is electrically connected to a first node and a second node. The first threshold compensation device includes a first power signal terminal, and is electrically connected to the first scanning signal terminal, the first node and a third node. The first data writing device includes a first data signal terminal, a second scanning signal terminal and a light emitting duration control signal terminal, and is electrically connected to the second node.

19 Claims, 23 Drawing Sheets

PIXEL DRIVING CIRCUIT, DISPLAY PANEL AND DRIVING METHOD

CROSS-REFERENCES TO RELATED APPLICATIONS

This application claims priority to a Chinese patent application No. 202010129869.1 filed on Feb. 28, 2020, disclosure of which is incorporated herein by reference in its entirety.

FIELD

The present disclosure relates to the field of display technologies and, in particular, to a pixel driving circuit, a display panel and a driving method.

BACKGROUND

A current-driven display panel, such as an organic light emitting diode (OLED) display panel and a light emitting diode (LED) display panel, has many advantages such as an all solid state, a wide viewing angle, a fast response, and the like and has a great application prospect in the display field.

Each pixel unit of the current-driven display panel includes pixel driving circuits and light emitting elements, the light emitting elements are current-driven devices, and the pixel driving circuits provide a driving current for each light emitting element, that is, the pixel driving circuits control light emitting brightness of the light emitting element by controlling the driving current. However, when light emitting elements of a same color are driven, due to different driving currents, which may cause differences in light emitting chromaticity of different light emitting elements, affecting display effects of the display panel. In one embodiment, according to requirements on image display, light emitting brightness of a red light emitting element A is LA, light emitting brightness of a red light emitting element B is LB, and LA is not equal to LB. If different driving currents are provided for the red light emitting element A and the red light emitting element B, which will cause differences in light emitting chromaticity between the red light emitting element A and the red light emitting element B.

SUMMARY

The present disclosure provides a pixel driving circuit, a display panel and a driving method, which are used for solving that light emitting elements of a same color have different display chromaticity under different display brightness.

One embodiment of the present disclosure provides a pixel driving circuit including a first initialization device, a first threshold compensation device, a first data writing device, a first light emitting control device and a light emitting adjustment device.

The first initialization device includes a first initialization signal terminal, a first initialization control terminal and a first scanning signal terminal, the first initialization device is electrically connected to a first node and a second node, and the first initialization device provides a first initialization signal to the first node.

The first threshold compensation device includes a first power signal terminal, the first threshold compensation device is electrically connected to the first scanning signal terminal, the first node and a third node, and the first threshold compensation device is used for compensating a potential of the first node.

The first data writing device includes a first data signal terminal, a second scanning signal terminal and a light emitting duration control signal terminal, the first data writing device is electrically connected to the second node, and the first data writing device adjusts the potential of the first node through the second node.

The first light emitting control device includes a first light emitting control signal terminal, and the first light emitting control device is electrically connected to the third node and a fourth node.

The light emitting adjustment device includes a second light emitting control signal terminal, a third scanning signal terminal, a second data signal terminal and an output terminal, the light emitting adjustment device is electrically connected to the first power signal terminal and the fourth node, and the light emitting adjustment device outputs a driving signal through the output terminal.

One embodiment of the present disclosure further provides a display panel including a light emitting element and the pixel driving circuit described in the embodiments.

Where, the output terminal of the pixel driving circuit is electrically connected to an anode of the light emitting element.

One embodiment of the present disclosure further provides a driving method of a pixel driving circuit, the pixel driving circuit described in the embodiment is used. The driving method includes steps described below.

In a first stage, the first initialization device writes a first initialization signal of the first initialization signal terminal into the first node.

In a second stage, the first threshold compensation device compensates the potential of the first node and the first initialization device writes the first initialization signal of the first initialization signal terminal into the second node.

In a third stage, the first data writing device writes a first data signal of the first data signal terminal into the second node.

In a fourth stage, the light emitting adjustment device writes a second data signal of the second data signal terminal into the fourth node.

In a fifth stage, the first data writing device adjusts the potential of the first node to disconnect a connection between the first power signal terminal and the third node, and the light emitting adjustment device outputs a driving signal through the output terminal.

In a sixth stage, the first light emitting control device is turned on, the first data writing device adjusts the potential of the first node, and the connection between the first power signal terminal and the third node is conductive, and an output terminal of the light emitting adjustment device is cut off.

The pixel driving circuit provided by the present disclosure includes the first initialization device, the first threshold compensation device, the first data writing device, the first light emitting control device and the light emitting adjustment device. Where, the first initialization device may write the first initialization signal of the first initialization signal terminal into the first node in the first stage, to reset the first node, the first threshold compensation device realizes the compensation of the potential of the first node in the second stage, while the first initialization device writes the first initialization signal of the first initialization signal terminal into the second node, the first data writing device writes the first data signal of the first data signal terminal into the second node in the third stage, which at this time can realize the disconnection of the connection between the third node and the first power signal terminal, the light emitting adjustment device writes the second data signal of the second data signal terminal into the fourth node in the fourth stage, the first data writing device may adjust the potential of the first node in the fifth stage to continuously keep disconnecting the first power signal terminal from the third node, to realize the light emitting adjustment device outputting the driving signal through the output terminal and the correspondingly connected light emitting element emitting light in the fifth stage. The first light emitting control device is turned on in the sixth stage, the first data writing device may adjust the potential of the first node through the light emitting duration control signal input by the light emitting duration control signal terminal in the sixth stage, the first power signal terminal is conductive with the third node in the sixth stage, so that the output terminal of the light emitting adjustment device is turned off, and no driving signal is output.

DETAILED DESCRIPTION

Figure 1:
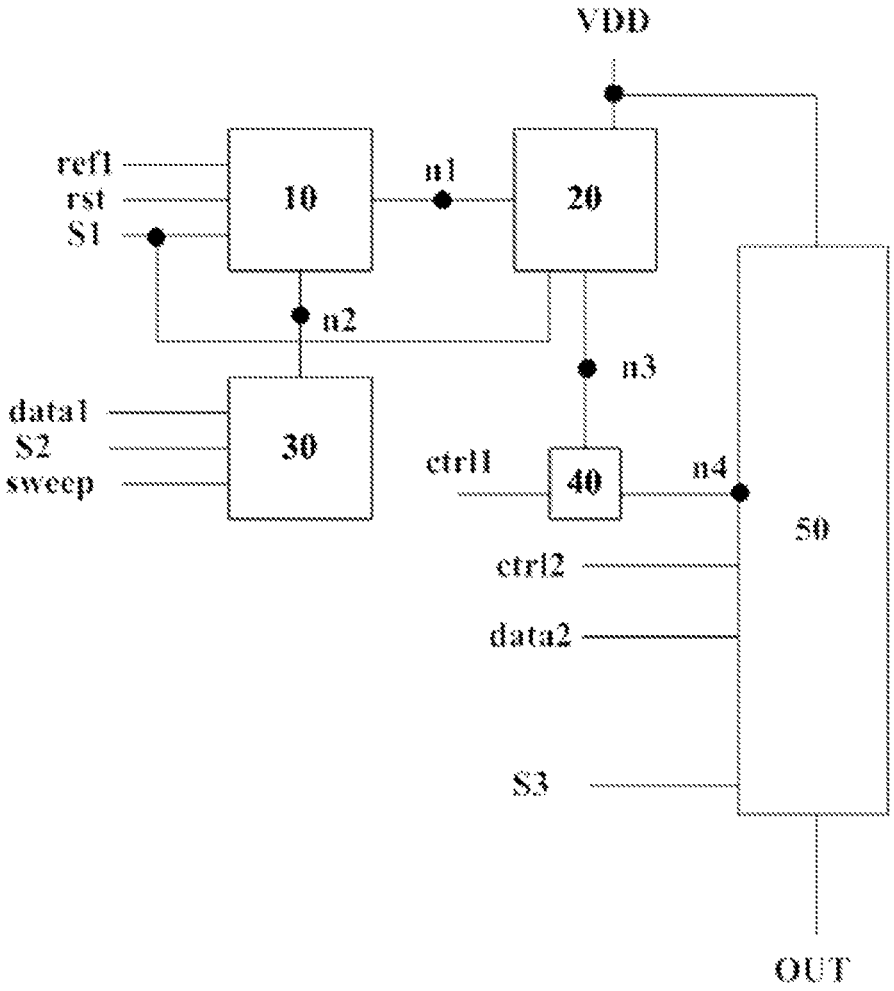
FIG. 1 is a structural diagram of a pixel driving circuit according to an embodiment of the present disclosure.

Hereinafter the present disclosure will be further described in detail with reference to the drawings and embodiments. It should to be understood that embodiments described below are intended to illustrate and not to limit the present disclosure. Additionally, it should be noted that, for ease of description, only part, not all, of structures related to the present disclosure are illustrated in the drawings.

FIG. 1 is a structural diagram of a pixel driving circuit according to an embodiment of the present disclosure. As shown in FIG. 1, the pixel driving circuit includes a first initialization device 10, a first threshold compensation device 20, a first data writing device 30, a first light emitting control device 40 and a light emitting adjustment device 50.

The first initialization device includes a first initialization signal terminal ref1, a first initialization control terminal rst and a first scanning signal terminal S1. The first initialization device 10 is electrically connected to a first node n1 and a second node n2, and the first initialization device 10 provides a first initialization signal to the first node n1 to implement reset of the first node n1. The first threshold compensation device 20 includes a first power signal terminal VDD, and the first threshold compensation device 20 is electrically connected to the first scanning signal terminal S1, the first node n1 and a third node n3. The first threshold compensation device 20 is used for compensating a potential of the first node n1. The first data writing device 30 includes a first data signal terminal data1, a second scanning signal terminal S2 and a light emitting duration control signal terminal sweep. The first data writing device 30 is electrically connected to the second node n2, and the first data writing device 30 adjusts the potential of the first node n1 through the second node n2. The first light emitting control device 40 includes a first light emitting control signal terminal ctrl1, and the first light emitting control device 40 is electrically connected to the third node n3 and a fourth node n4. The light emitting adjustment device 50 includes a second light emitting control signal terminal ctrl2, a third scanning signal terminal S3, a second data signal terminal data2 and an output terminal OUT. The light emitting adjustment device 50 is electrically connected to the first power signal terminal VDD and the fourth node n4. The light emitting adjustment device 50 outputs a driving signal through the output terminal OUT to drive a light emitting element electrically connected to the output terminal OUT to emit light.

Figure 2:
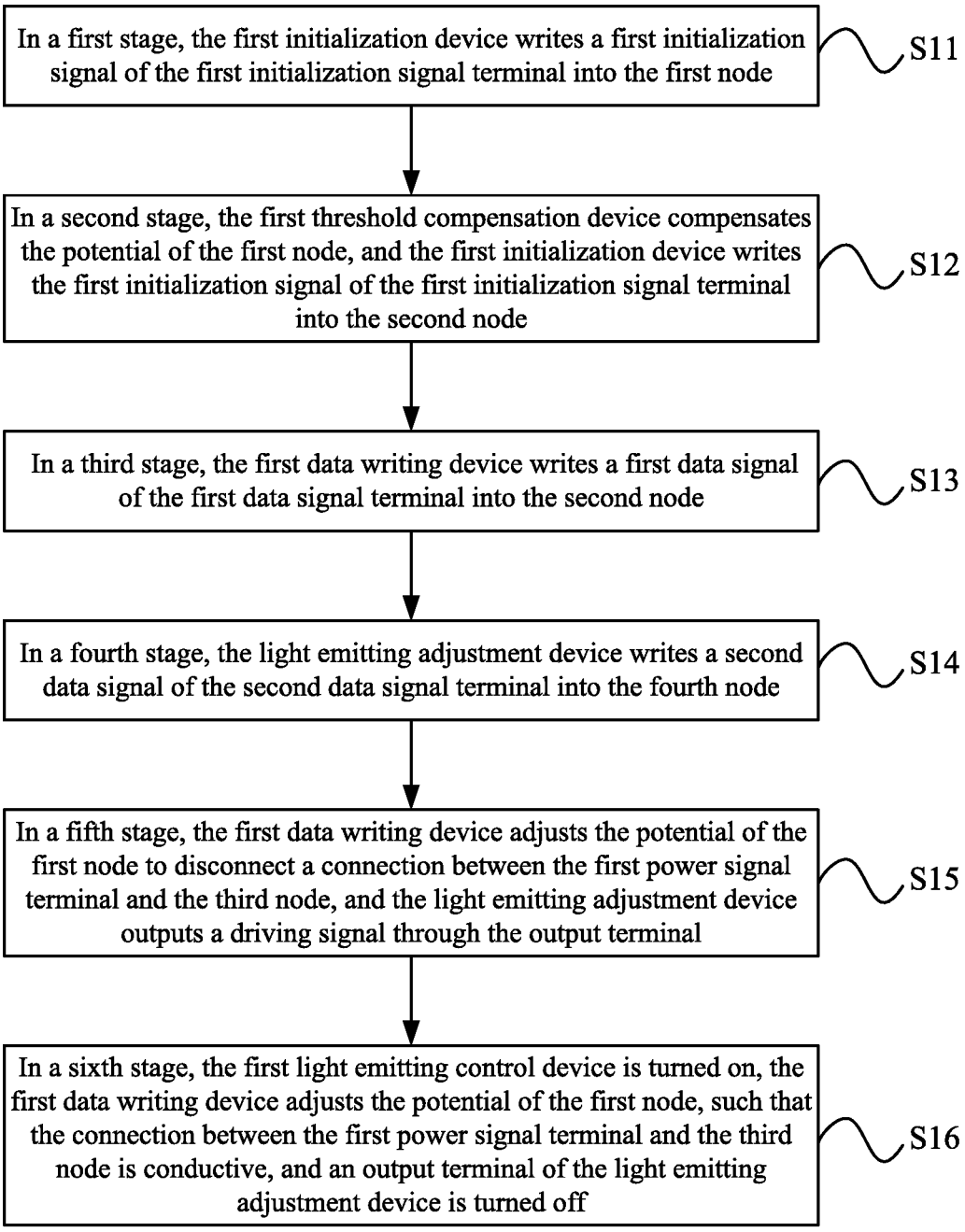
FIG. 2 is a flow diagram of a driving method of a pixel driving circuit according to an embodiment of the present disclosure.

In addition, an embodiment of the present disclosure further provides a driving method of a pixel driving circuit and the method may use the pixel driving circuit shown in FIG. 1. FIG. 2 is a flow diagram of a driving method of a pixel driving circuit according to an embodiment of the present disclosure, and the method includes steps described below.

S11, in a first stage, the first initialization device writes a first initialization signal of the first initialization signal terminal into the first node.

In the first stage, the first initialization control signal input by the first initialization control terminal rst controls the first initialization device 10 to write the first initialization signal of the first initialization signal terminal ref1 into the first node n1, that is, the potential of the first node is n1=Vref1, to implement reset of the first node n1, which can avoid that a potential remaining at the first node n1 interferes with a pixel driving process when displaying a previous frame image.

S12, in a second stage, the first threshold compensation device compensates the potential of the first node, and the first initialization device writes the first initialization signal of the first initialization signal terminal into the second node.

In the second stage, a first scanning signal input by the first scanning signal terminal S1 controls the first threshold compensation device 20 to be turned on, and the first threshold compensation device 20 compensates the potential of the first node n1. In addition, the first scanning signal input by the first scanning signal terminal S1 controls the first initialization device 10 to write the first initialization signal of the first initialization signal terminal ref1 into the second node n2, that is, the potential of the second node is n2=Vref1, to implement reset of the second node n2.

S13, in a third stage, the first data writing device writes a first data signal of the first data signal terminal into the second node.

In the third stage, the first scanning signal input by the second scanning signal terminal S2 controls the first data writing device 30 to write the first data signal of the first data signal terminal data1 into the second node n2, that is, the potential of the second node is n2=Vdata1, since the potential of the second node n2 changes by Vdata1−Vref1, the potential of the first node n1 also changes by Vdata1−Vref1 accordingly. The changed potential of the first node n1 enables a connection between the first power signal terminal VDD and the third node n3 to be disconnected.

S14, in a fourth stage, the light emitting adjustment device writes a second data signal of the second data signal terminal into the fourth node.

In the fourth stage, the third scanning signal input by the third scanning signal terminal S3 controls the light emitting adjustment device 50 to write the second data signal of the second data signal terminal data2 into the fourth node n4.

S15, in a fifth stage, the first data writing device adjusts the potential of the first node to disconnect the connection between the first power signal terminal and the third node, and the light emitting adjustment device outputs a driving signal through the output terminal.

In the fifth stage, a light emitting duration control signal input by the light emitting duration control signal terminal sweep changes, so that the potential of the first node n1 may be adjusted, and during this stage, although the potential of the first node n1 changes, but the potential of the first node n1 may still control the first threshold compensation device to keep the first power signal terminal VDD being disconnected from the third node n3. The second light emitting control signal input by the second light emitting control signal terminal ctrl2 controls the light emitting adjustment device 50 to be turned on, and the light emitting adjustment device 50 outputs the driving signal through the output terminal OUT during this stage, to drive the light emitting element electrically connected to the output terminal OUT to emit light. Duration of the fifth stage is light emitting duration of the light emitting element electrically connected to the output terminal OUT.

S16, in a sixth stage, the first light emitting control device is turned on, the first data writing device adjusts the potential of the first node, so that the connection between the first power signal terminal and the third node is conductive, and an output terminal of the light emitting adjustment device is turned off.

In the sixth stage, a second light emitting control signal input by the first light emitting control signal terminal ctrl1 controls the first light emitting control device 40 to be turned on. The light emitting duration control signal input by the light duration control signal terminal sweep continues to change to adjust the potential of the first node n1. When the light emitting duration control signal changes to the potential of the first node n1, the first threshold compensation device is controlled to enable the conductivity between the first power signal terminal and the third node. Since the first light emitting controlling device 40 is also turned on, the potential of the fourth node is n4=VDD, the output terminal OUT of the light emitting adjustment device 50 is turned off, and the light emitting element electrically connected to the output terminal OUT stops emitting light.

The embodiments of the present disclosure can provide a same second data signal for pixel driving circuits electrically connected to light emitting elements of a same color, so when emitting light, the light emitting elements of the same color which are driven by the pixel driving circuits have a same driving signal and keep consistent chromaticity. On the basis, in order to implement that the light emitting elements of the same color have different light emitting brightness, the duration of the driving signal output by the output terminal of the light emitting adjustment device can be controlled through the light emitting duration control signal and the first data signal. The duration of the driving signal output by the output terminal of the light emitting adjustment device is light emitting duration of the light emitting element electrically connected to the output terminal of the light emitting adjustment device. The longer the light emitting duration of the light emitting element is, the larger a ratio of the light emitting duration to a driving period of the pixel driving circuit (the driving period of the pixel driving circuit refers to a total time from the first stage to the sixth stage), thus the more gray-scale brightness can be perceived by human eyes. Therefore, the embodiments of the present disclosure can adjust the duration of the driving signal output by the output terminal of the light emitting adjustment device, and implement requirements of different light emitting brightness of the light emitting elements of the same color, meanwhile, it will not cause chromaticity differences.

It should be noted that, structures of the first initialization device, the first threshold compensation device, the first data writing device, the first light emitting control device, and the light emitting adjustment device are not limited in the embodiments of the present disclosure. On the premise that devices may write or compensate a potential of each node in a corresponding stage to implement that the light emitting elements of the same color output a same driving signal value, and the light emitting duration of the light emitting elements driven by the pixel circuit is controlled by adjusting the duration of the driving signal output by the light emitting adjustment device through the output terminal, the structures of the devices of the pixel driving circuit may be designed according to actual needs.

Figure 3:
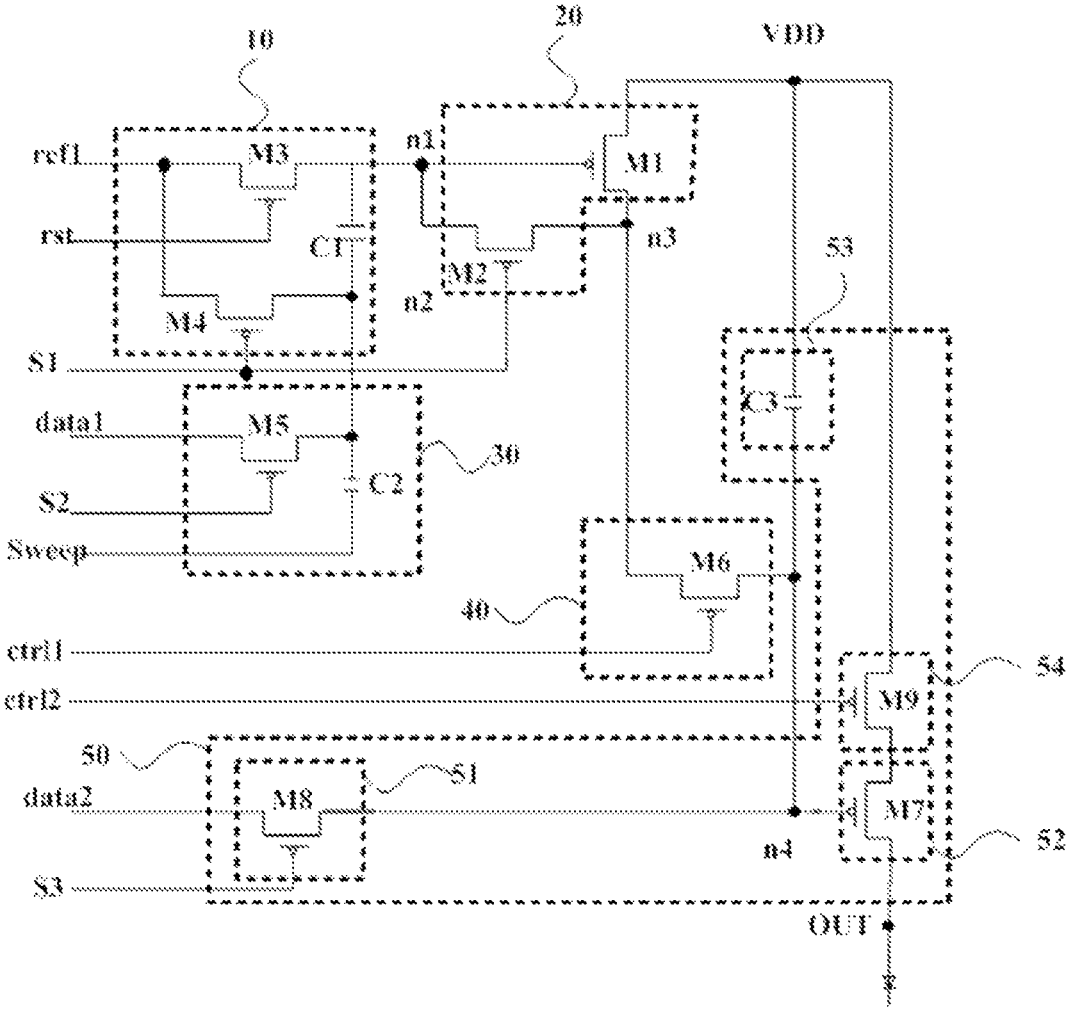
FIG. 3 is a structural diagram of another pixel driving circuit according to an embodiment of the present disclosure.

Several implementations of the devices in the pixel driving circuit are provided below. FIG. 3 is a structural diagram of another pixel driving circuit according to an embodiment of the present disclosure.

Referring to FIG. 3, the first initialization device 10 includes a third transistor M3, a fourth transistor M4 and a first capacitor C1. A first electrode of the third transistor M3 and a first electrode of the fourth transistor M4 are both electrically connected to the first initialization signal terminal ref1. A second electrode of the third transistor M3 and a first plate of the first capacitor C1 are electrically connected to the first node n1. A gate electrode of the third transistor M3 is electrically connected to the first initialization control terminal rst. A second electrode of the fourth transistor M4 and a second plate of the first capacitor C1 are electrically connected to the second node n2. A gate electrode of the fourth transistor M4 is electrically connected to the first scanning signal terminal S1.

In the first stage, the third transistor M3 is controlled to be turned on by the first initialization control signal input by the first initialization control terminal rst, the first initialization signal of the first initialization signal terminal ref1 is written into the first node n1 to reset the first node n1, and the potential of the first node is n1=Vref1. The reset of the first node n1 in the first stage can avoid that a potential remaining at the first node n1 interferes with the pixel driving process when displaying a previous frame image. In the second stage, the fourth transistor M4 is controlled to be turned on by the first scanning signal input by the first scanning signal terminal S1, the fourth transistor M4 writes the first initialization signal of the first initialization signal terminal ref1 into the second node n2, and the potential of the second node is n2=Vref1, implementing reset of the second node n2.

With continued reference to FIG. 3, the first threshold compensation device 20 includes a first transistor M1 and a second transistor M2. A first electrode of the first transistor M1 is electrically connected to the first power signal terminal VDD, a second electrode of the first transistor M1 and a first electrode of the second transistor M2 are electrically connected to the third node n3, a gate electrode of the first transistor M1 and a second electrode of the second transistor M2 are electrically connected to the first node n1, and a gate electrode of the second transistor M2 is electrically connected to the first scanning signal terminal S1.

In the second stage, the second transistor M2 is controlled to be turned on by the first scanning signal input by the first scanning signal terminal S1, the first power signal terminal VDD may provide the first power signal to the first node n1, the second transistor M2 is turned on, and a threshold voltage $V_{th}$(M1) of the first transistor M1 can be compensated to the first node n1, so that a driving current generated by the first transistor M1 is unrelated to the threshold voltage of the first transistor M1. At this time, the potential of the first node is n1=VDD−|$V_{th}$(M1)|.

Referring to FIG. 3, the first data writing device 30 includes a fifth transistor M5 and a second capacitor C2. A first electrode of the fifth transistor is electrically connected to the first data signal terminal data1. A second electrode of the fifth transistor M5 and a first plate of the second capacitor C2 are electrically connected to the second node n2. A gate electrode of the fifth transistor M5 is electrically connected to the second scanning signal terminal S2. A second plate of the second capacitor C2 is electrically connected to the light emitting duration control signal terminal sweep.

In the third stage, the second scanning signal input by the second scanning signal terminal S2 controls the fifth transistor M5 to be turned on, to write the first data signal of the first data signal terminal data1 into the second node n2, that is, the potential of the second is n2=Vdata1. The potential of the first node n1 is changed due to a change of the potential of the second node n2. Until the potential of the first node n1 controls the first threshold compensation device 20 to disconnect the connection between the first power signal terminal VDD and the third node n3.

Referring to FIG. 3, the light emitting adjustment device 50 includes a second data writing device 51, a driving device 52, a storage device 53 and a second light emitting control device 54. The second data writing device 51 includes the second data signal terminal data2 and the third scanning signal terminal S3, and the second data writing device 51 is electrically connected to the fourth node n4. An output terminal of the driving device 52 is the output terminal OUT of the light emitting adjustment device 50, and a control terminal of the driving device 52 is electrically connected to the fourth node n4. The second light emitting control device 54 includes the second light emitting control signal terminal ctrl2, and the second light emitting control device 54 is electrically connected between the first power signal terminal VDD and an input terminal of the driving device 52. The storage device 53 is electrically connected between the first power signal terminal VDD and the fourth node n4.

It should be noted that, circuit structures of the second data writing device, the driving device, the storage device, and the second light emitting control device in the light emitting adjustment device are not limited in the embodiments of the present disclosure, as long as the above connection relationships are satisfied, the second data writing device may write the second data signal of the second data signal terminal into the fourth node in the fourth stage, the driving device and the second light emitting control device are turned on in the fifth stage, so that the light emitting adjustment device outputs the driving signal through the output terminal, the driving device is turned off in the sixth stage, and the output terminal of the light emitting adjustment device does not output the driving signal. On the basis, the circuit structures of the devices in the light emitting adjustment device may be set according to an actual design requirement.

On the basis of the foregoing embodiments, the embodiments of the present disclosure further provide a circuit structure of the light emitting adjustment device. Referring to FIG. 3, the driving device 52 includes a seventh transistor M7, the second data writing device 51 includes an eighth transistor M8, the second light emitting control device 54 includes a ninth transistor M9, and the storage device 53 includes a third capacitor C3. A first electrode of the seventh transistor M7 is electrically connected to a second electrode of the ninth transistor M9, a second electrode of the seventh transistor M7 is the output terminal of the driving device 52, a first electrode of the ninth transistor M9 is electrically connected to the first power signal terminal VDD, a gate electrode of the ninth transistor M9 is electrically connected to the first light emitting control signal terminal ctrl1, a first electrode of the eighth transistor M8 is electrically connected to the second data signal terminal data2, a second electrode of the eighth transistor M8 and a gate electrode of the seventh transistor M7 are both electrically connected to the fourth node n4, a gate electrode of the eighth transistor M8 is electrically connected to the third scanning signal terminal S3, and the third capacitor C3 is electrically connected between the first power signal terminal VDD and the fourth node n4.

Referring to FIG. 3, the first light emitting control device 40 includes a sixth transistor M6. A gate electrode of the sixth transistor M6 is electrically connected to the first light-emitting control signal terminal ctrl1. A first electrode of the sixth transistor M6 is electrically connected to the third node n3. A second electrode of the sixth transistor M6 is electrically connected to the fourth node n4.

The sixth transistor M6 is controlled to be turned on by the first light emitting control signal input by the first light emitting control signal terminal ctrl1. During this stage, the light emitting duration control signal input by the light emitting duration control signal terminal sweep will continuously adjust the potential of the first node n1, to control the first power signal terminal VDD to be conductive with the third node n3, therefore, the first power signal terminal VDD may be written into the fourth node n4 through the sixth transistor M6, to control the output terminal of the light emitting adjustment device no longer to output the driving signal, that is, to control the light emitting element electrically connected to the output terminal of the light emitting adjustment device no longer to emit light.

Figure 4:
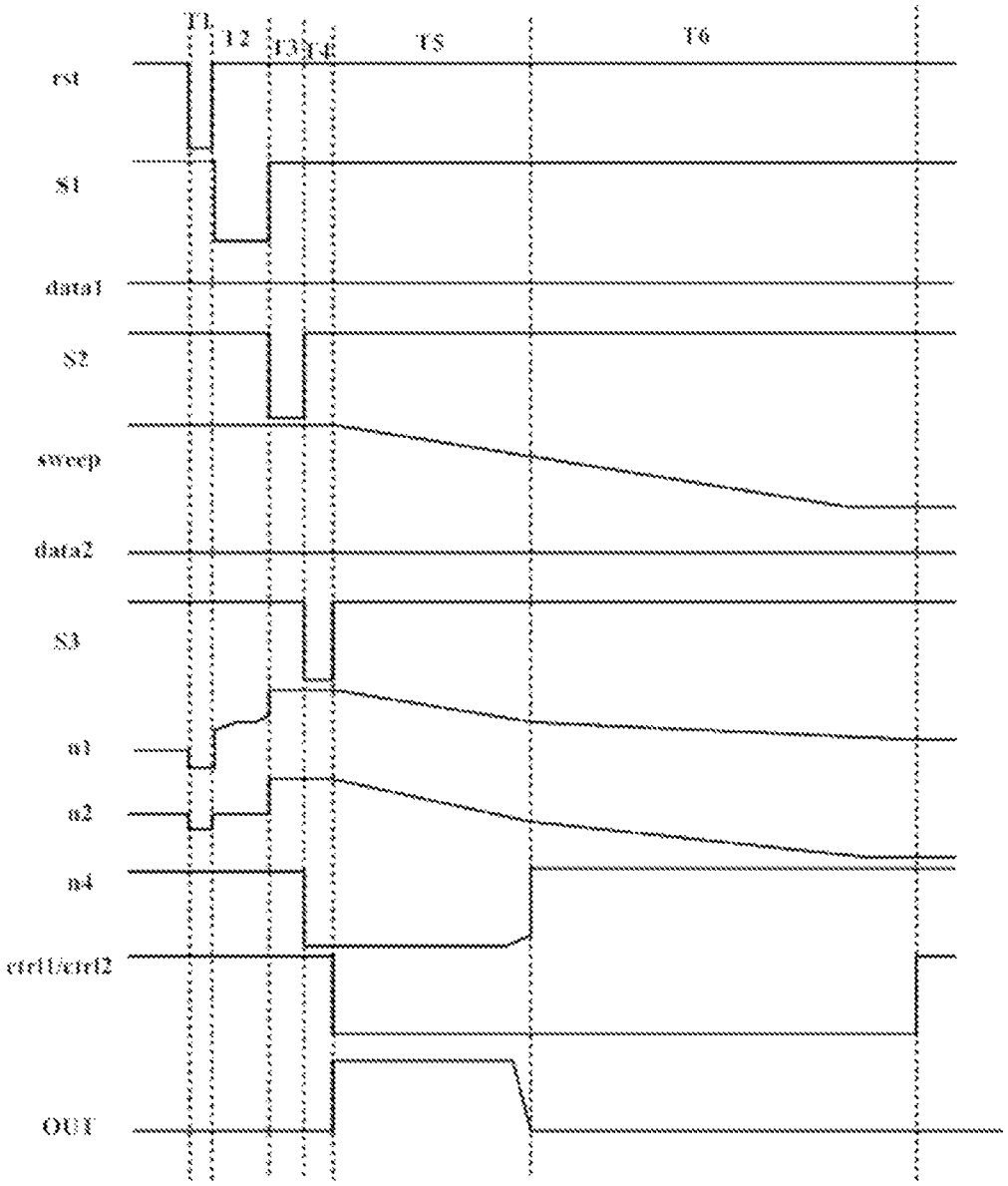
FIG. 4 is a driving timing diagram of the pixel driving circuit shown in FIG. 3.

FIG. 4 is a driving timing diagram of the pixel driving circuit shown in FIG. 3. In FIG. 3 and FIG. 4, exemplary descriptions are based on the example that each transistor of the pixel driving circuit is a P-type transistor. In other implementations, each transistor of the pixel driving circuit may also be an N-type transistor, or a part of transistors are set to be N-type and the other part of the transistors are set to be P-type according to actual requirements. The embodiments of the present disclosure do not limit types of the transistors in the pixel driving circuit.

Figure 5:
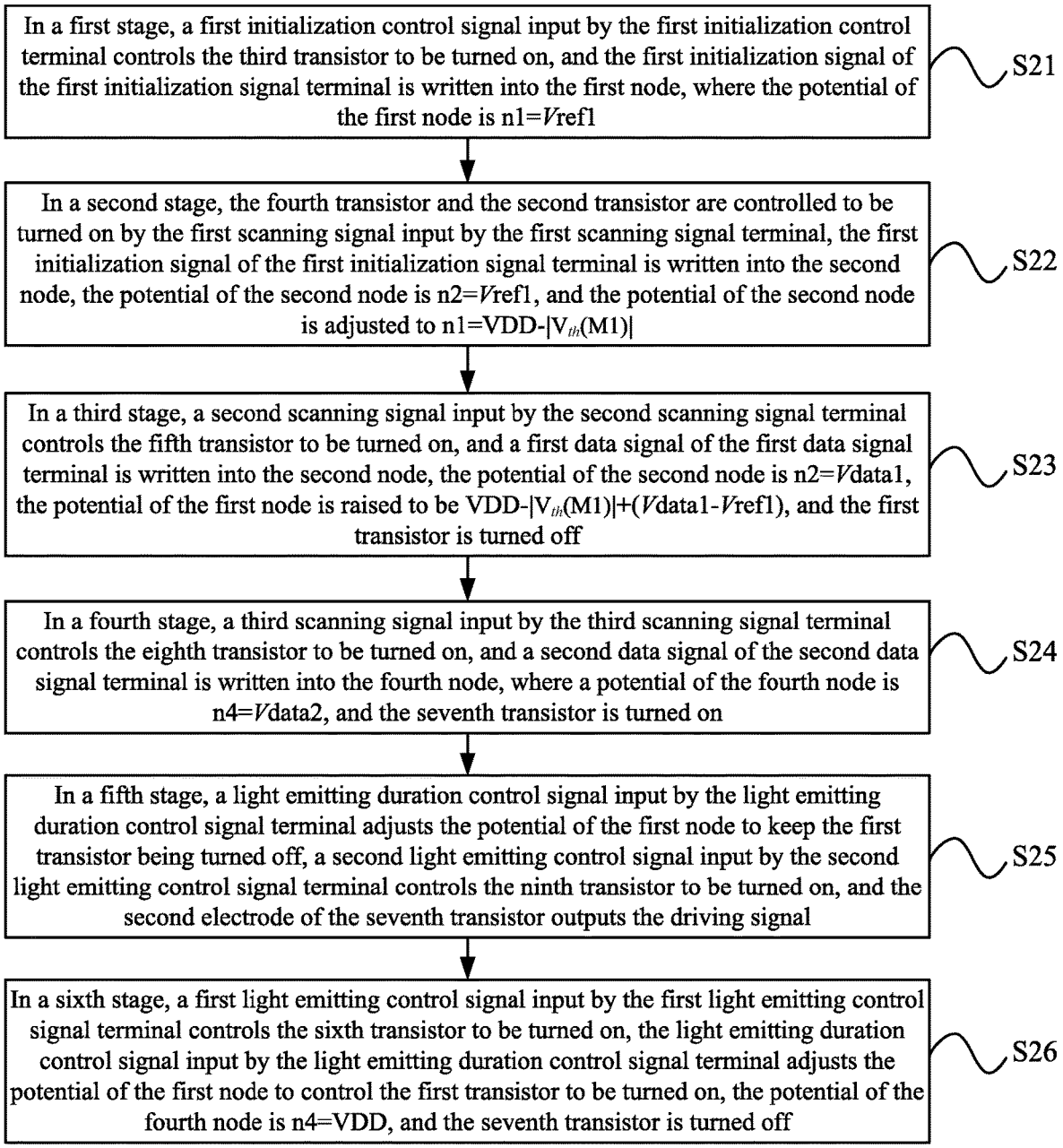
FIG. 5 is a flow diagram of a driving method of another pixel driving circuit according to an embodiment of the present disclosure.

FIG. 5 is a flow diagram of a driving method of another pixel driving circuit according to an embodiment of the present disclosure. Referring to FIG. 3 to FIG. 5, the driving method of the pixel driving circuit provided by the present disclosure includes steps described below.

S21, in a first stage, the first initialization control signal input by the first initialization control terminal controls the third transistor to be turned on, and the first initialization signal of the first initialization signal terminal is written into the first node, where the potential of the first node is n1=Vref1.

Figure 6:
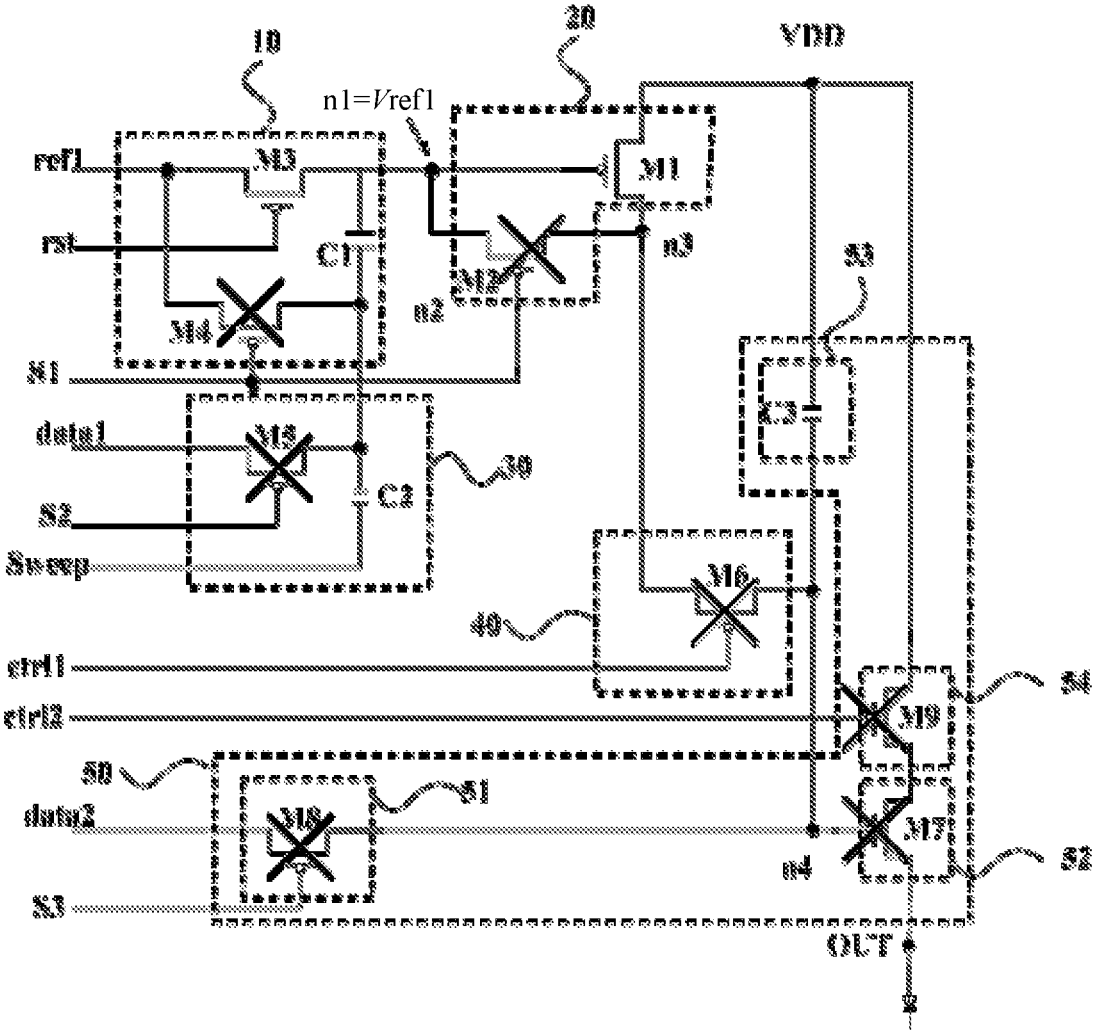
FIG. 6 is a schematic diagram illustrating on-state of each transistor of the pixel driving circuit in FIG. 3 in a first stage.

On-state of each transistor in the pixel driving circuit in the first stage T1 is referred to FIG. 6, the first initialization control signal input by the first initialization control terminal ref1 is at a low level, the third transistor M3 is turned on, the potential of the first node is n1=Vref1, and the first transistor M1 is turned on.

S22, in a second stage, the first scanning signal input by the first scanning signal terminal controls the fourth transistor and the second transistor to be turned on, the first initialization signal of the first initialization signal terminal is written into the second node, the potential of the second node is n2=Vref1, and the potential of the first node is adjusted to n1=VDD−|$V_{th}$(M1)|.

Figure 7:
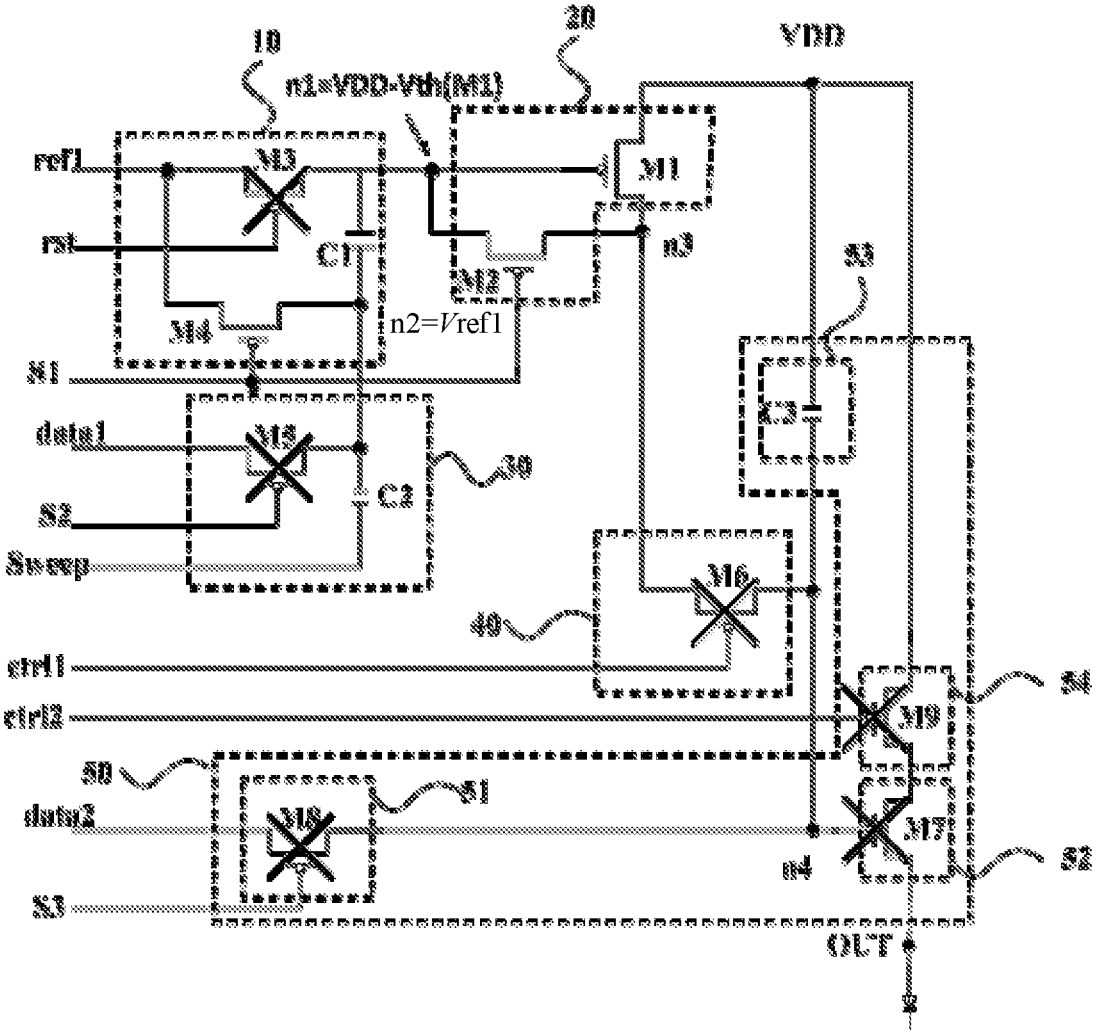
FIG. 7 is a schematic diagram illustrating on-state of each transistor of the pixel driving circuit in FIG. 3 in a second stage.

On-state of each transistor in the pixel driving circuit in the second stage T2 is referred to FIG. 7, the first scanning signal input by the first scanning signal terminal S1 is at a low level, and the fourth transistor M4 and the second transistor M2 are turned on. The fourth transistor M4 writes the first initialization signal of the first initialization signal terminal ref1 into the second node n2, that is n2=Vref1. Since the first transistor M1 and the second transistor M2 are both turned on, the first power signal terminal VDD provides the first power signal for the first node n1. Due to a threshold compensation effect of the second transistor M2, a threshold voltage $V_{th}$(M1) of the first transistor M1 is compensated to the first node n1, so that the driving current generated by the first transistor M1 is unrelated to the threshold voltage of the first transistor M1. At this time, the potential of the first node is n1=VDD−|$V_{th}$(M1)|.

S23, in a third stage, a second scanning signal input by the second scanning signal terminal controls the fifth transistor to be turned on, and a first data signal of the first data signal terminal is written into the second node, the potential of the second node is n2=Vdata1, the potential of the first node is raised to VDD−|$V_{th}$(M1)|+(Vdata1−Vref1), and the first transistor is turned off.

Figure 8:
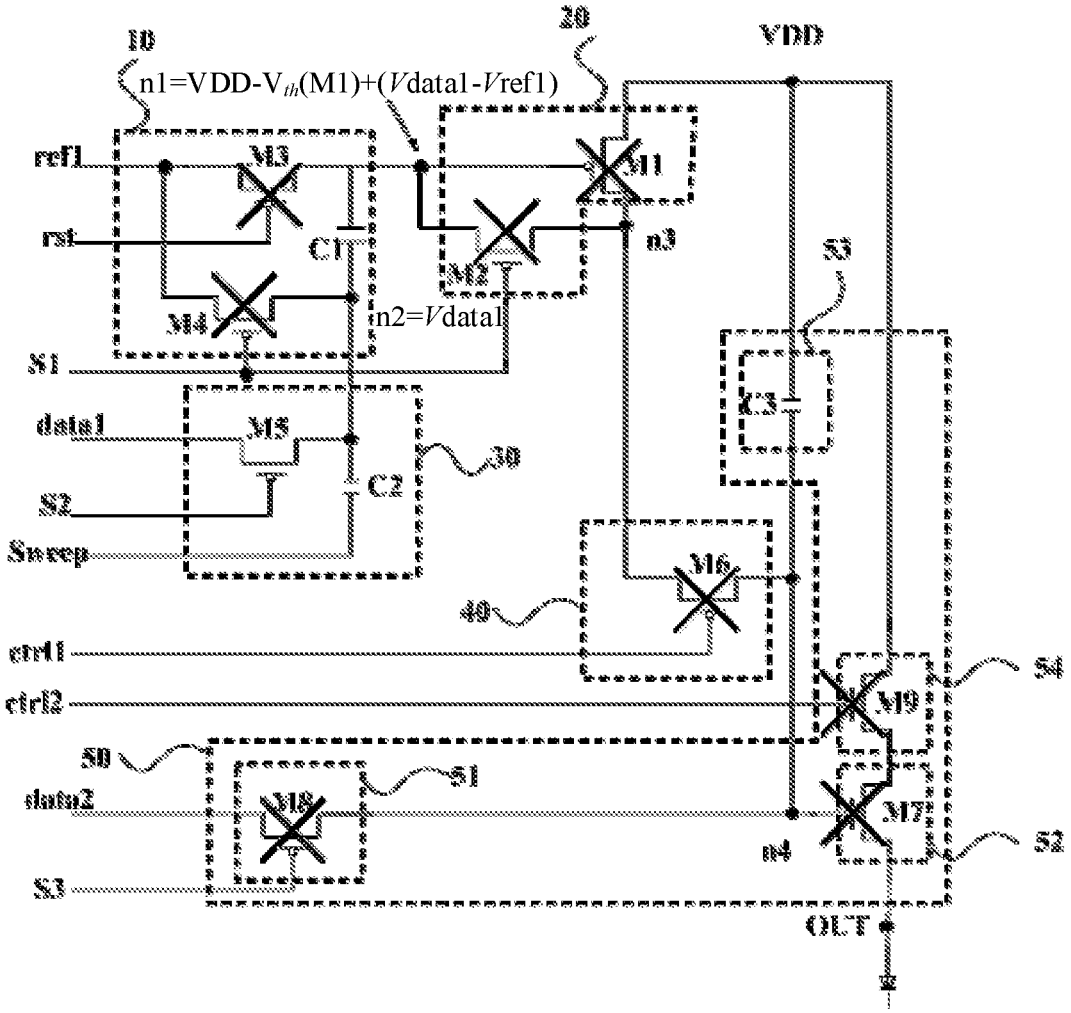
FIG. 8 is a schematic diagram illustrating on-state of each transistor of the pixel driving circuit in FIG. 3 in a third stage.

On-state of each transistor in the pixel driving circuit in the third stage T3 is referred to FIG. 8, the second scanning signal input by the second scanning signal terminal S2 is at a low level to control the fifth transistor M5 to be turned on, the fifth transistor M5 writes the first data signal of the first data signal terminal data1 into the second node n2, and the potential of the second node is n2=Vdata1. Since the potential of the second node n2 changes by data1−ref1, the first capacitor C1 raises the potential of the first node to n1=VDD−|$V_{th}$(M1)|+(Vdata1−Vref1), and the first transistor M1 is turned off.

S24, in a fourth stage, a third scanning signal input by the third scanning signal terminal controls the eighth transistor to be turned on and a second data signal of the second data signal terminal is written into the fourth node, where a potential of the fourth node is n4=Vdata2, and the seventh transistor is turned on.

Figure 9:
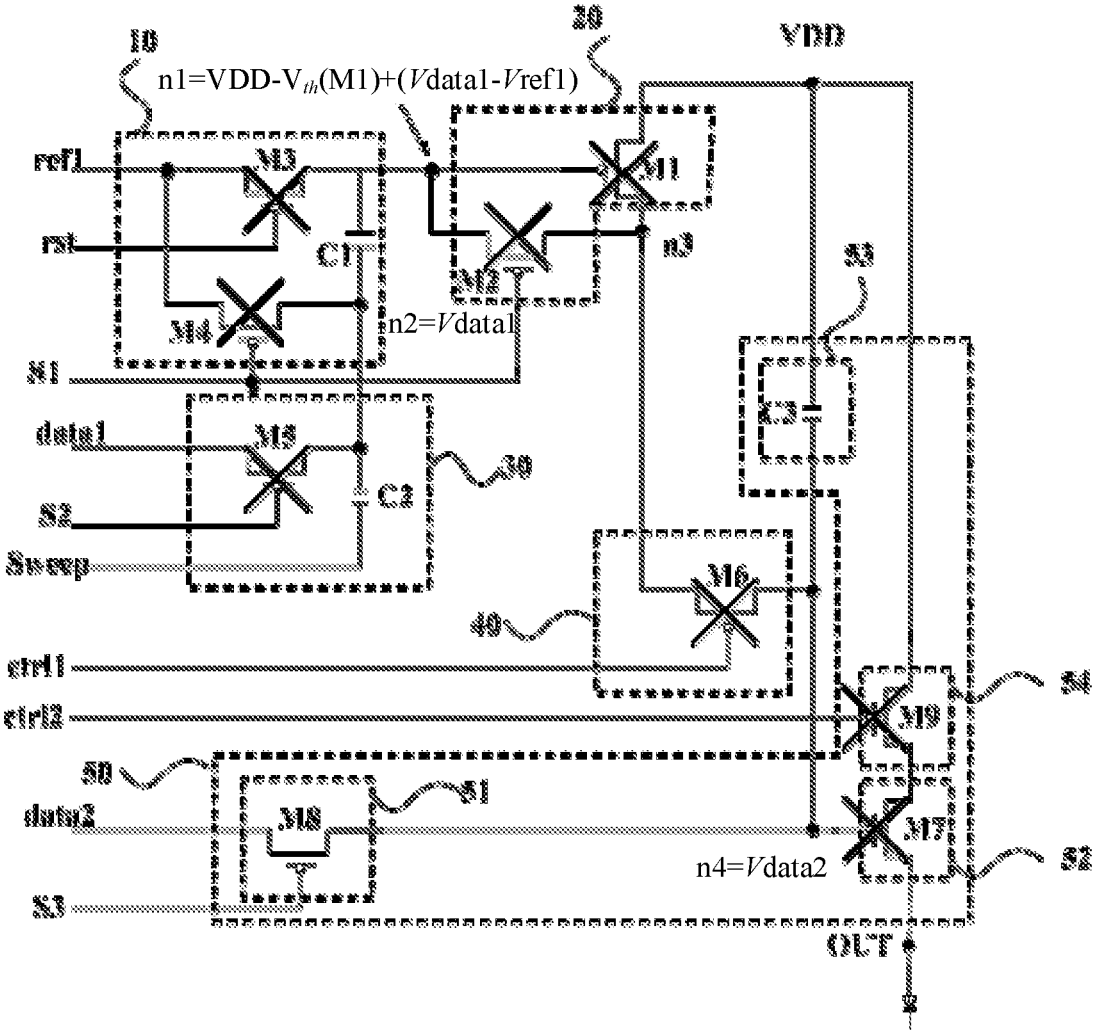
FIG. 9 is a schematic diagram illustrating on-state of each transistor of the pixel driving circuit in FIG. 3 in a fourth stage.

On-state of each transistor in the pixel driving circuit in the fourth stage T4 is referred to FIG. 9, the third scanning signal input by the third scanning signal terminal S3 is at a low level, and the eighth transistor M8 is controlled to be turned on. The eighth transistor M8 writes the second data signal of the second data signal terminal data2 into the fourth node n4, the potential of the fourth node is n4=Vdata2, and the seventh transistor M7 is turned on. A magnitude of the driving signal (driving current) of the light emitting element electrically connected to the output terminal OUT is related to the second data signal. Therefore, the second data signal can control the magnitude of the driving signal of the pixel driving circuit for driving the light emitting element.

S25, in a fifth stage, a light emitting duration control signal input by the light emitting duration control signal terminal adjusts the potential of the first node to keep the first transistor being turned off, a second light emitting control signal input by the second light emitting control signal terminal controls the ninth transistor to be turned on, and the second electrode of the seventh transistor outputs the driving signal.

Figure 10:
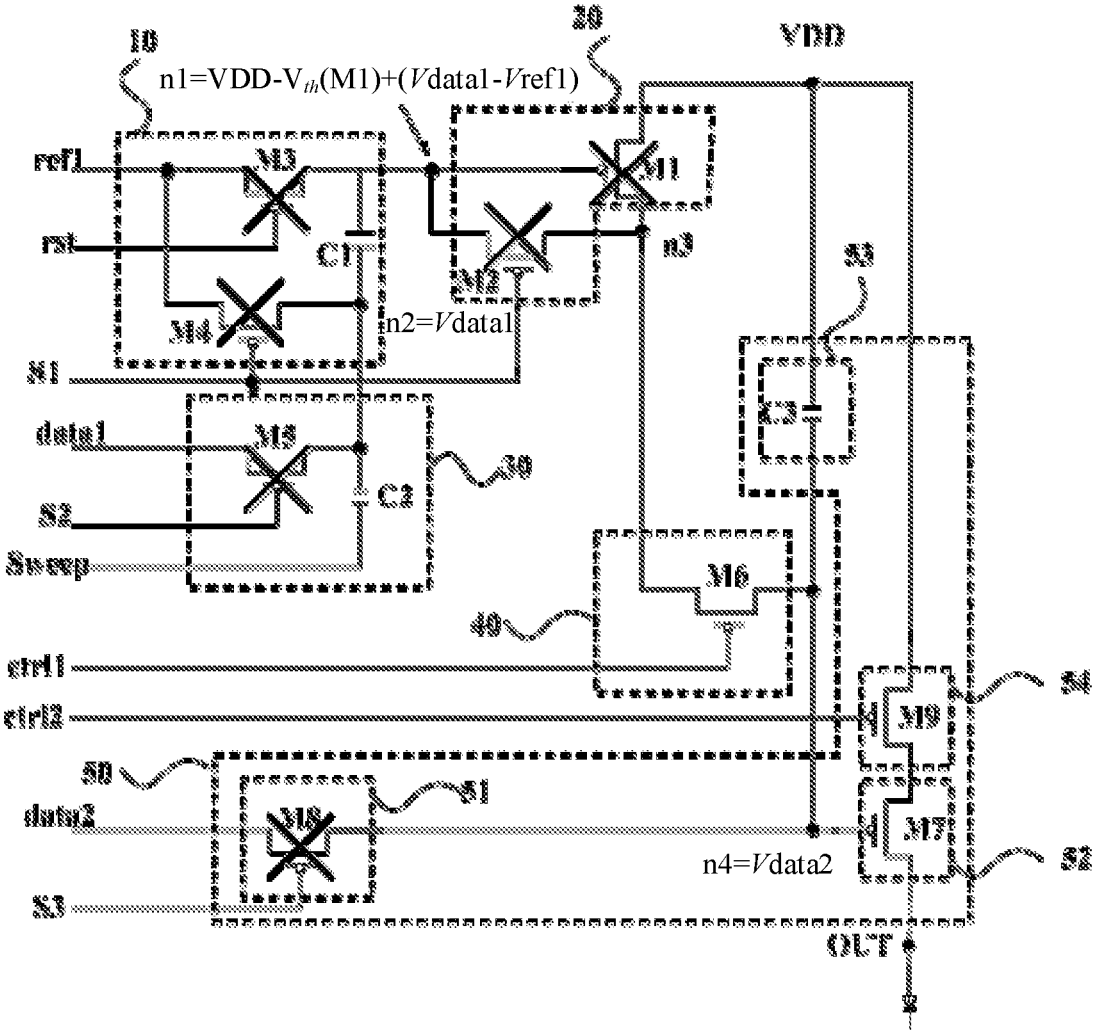
FIG. 10 is a schematic diagram illustrating on-state of each transistor of the pixel driving circuit in FIG. 3 in a fifth stage.

On-state of each transistor in the pixel driving circuit in the fifth stage T5 is referred to FIG. 10, the light emitting duration control signal input by the light emitting duration control signal terminal sweep adjusts the potential of the first node n1. Although in the fifth stage, the light emitting duration control signal continues to fall, which causes the potential of the first node n1 to fall, but the potential of the first node n1 in the fifth stage is always greater than VDD−|$V_{th}$(M1)|, therefore the first transistor M1 remains off. During this stage, the ninth transistor M9 is controlled to be turned on by the second light emitting control signal input by the second light emitting control signal terminal ctrl2. Since the seventh transistor M7 is also turned on at this time, the second electrode of the seventh transistor M7 outputs the driving signal, so that the light emitting element may be driven to emit light. In this stage, since the magnitude of the driving signal for driving the light emitting element to emit light is related to the second data signal data2, the pixel driving circuits correspondingly connected to all light emitting elements of a same color can be controlled to have a same second data signal input in this stage, implementing chromaticity uniformity of all light emitting elements of the same color. In addition, light emitting brightness of the light emitting elements can be controlled through the duration of the fifth stage, and the duration of the fifth stage is controlled by the first data signal and the light emitting duration control signal, therefore the light emitting brightness of each light emitting elements can be controlled through the first data signal and the light emitting duration control signal according to display requirements.

S26, in a sixth stage, the first light emitting control signal input by the first light emitting control signal terminal controls the sixth transistor to be turned on, the light emitting duration control signal input by the light emitting duration control signal terminal adjusts the potential of the first node to control the first transistor to be turned on, the potential of the fourth node is n4=VDD and the seventh transistor is turned off.

Figure 11:
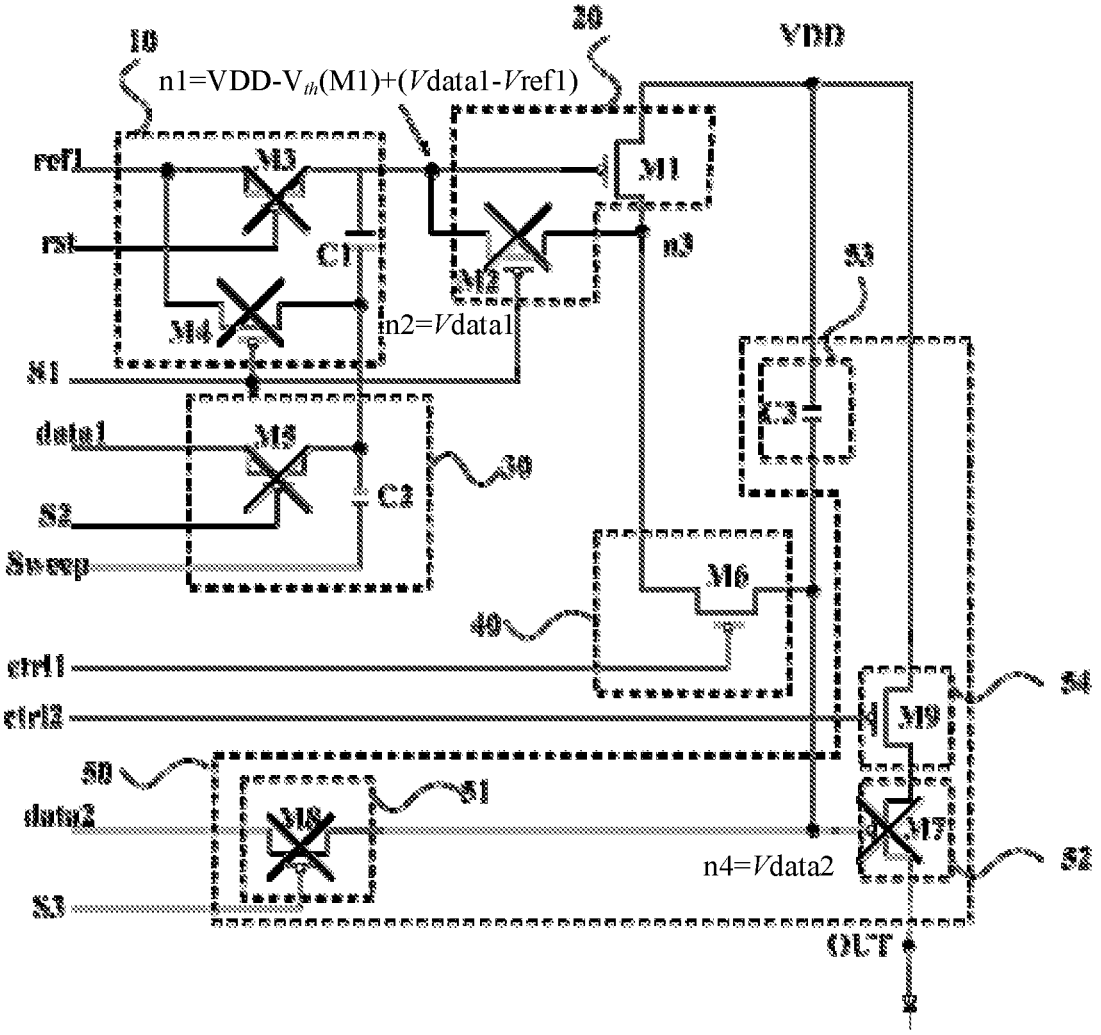
FIG. 11 is a schematic diagram illustrating on-state of each transistor of the pixel driving circuit in FIG. 3 in a sixth stage.

On-state of each transistor in the pixel driving circuit in the sixth stage T6 is referred to FIG. 11, the first light emitting control signal input by the first light emitting control signal terminal ctrl1 controls the sixth transistor M6 to be turned on, the light emitting duration control signal input by the light emitting duration control signal terminal sweep adjusts the potential of the first node. When the potential of the first node drops to n1=VDD−|$V_{th}$(M1)|, the first transistor M1 is in a critical on state, that is, the first transistor M1 is turned on at the beginning of the sixth stage. The first power signal terminal VDD writes the first power signal into the fourth node n4 through the first transistor M1 and the sixth transistor M6, the potential of the fourth node is n4=VDD, the seventh transistor M7 is turned off, and the second electrode of the seventh transistor M7 stops outputting the driving signal.

Where, ref1 is the first initialization signal, VDD is the first power signal, $V_{th}$(M1) is the threshold voltage of the first transistor, data1 is the first data signal, and data2 is the second data signal. For convenience of descriptions, the signal input by each signal terminal and the each signal terminal are denoted by a same symbol in the present disclosure, for example, both the first initialization signal terminal and the first initialization signal are denoted by ref1.

It should be noted that, since driving processes of the third stage and the fourth stage do not conflict with each other, that is, the driving process of the fourth stage may be executed during the third stage, the third stage may overlap with the fourth stage. Exemplarily shown in FIG. 4, the fourth stage T4 is executed after the third stage T3 is executed, which is not limited to the embodiments of the present disclosure.

Figure 12:
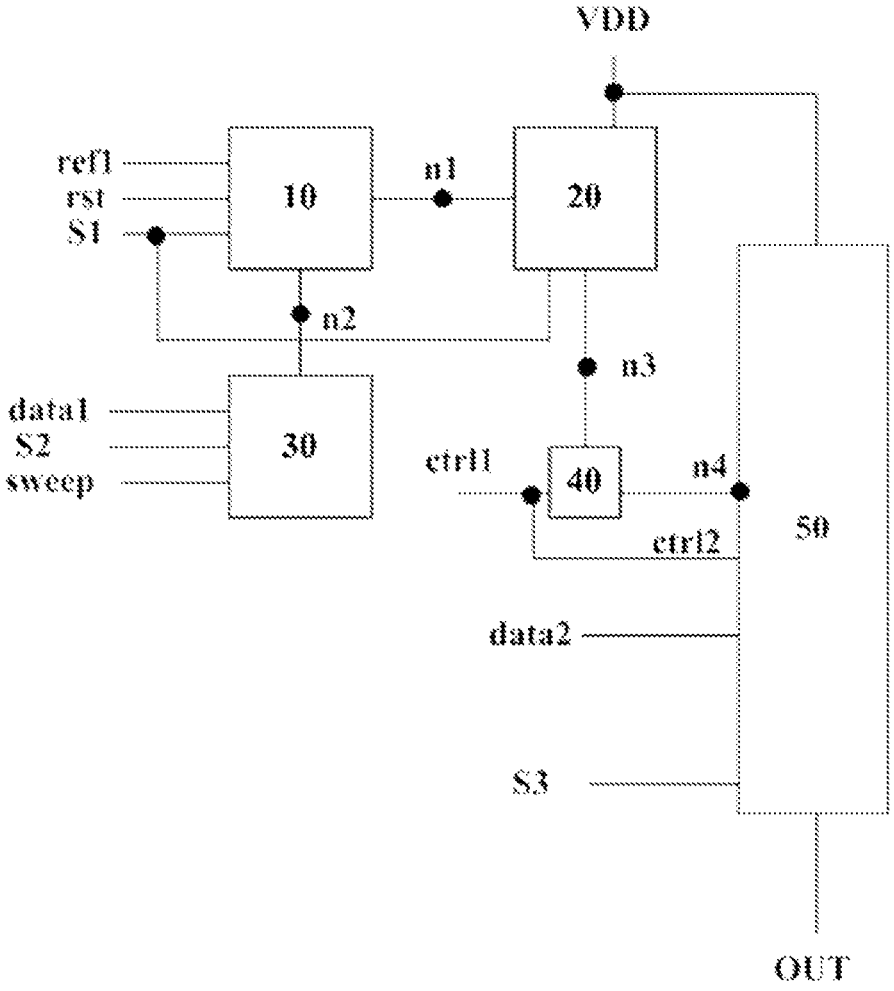
FIG. 12 is a structural diagram of another pixel driving circuit according to an embodiment of the present disclosure.

FIG. 12 is a structural diagram of another pixel driving circuit according to an embodiment of the present disclosure, which has a difference compared with the pixel driving circuit in FIG. 1, that the first light emitting control signal terminal ctrl1 and the second light emitting control signal terminal ctrl2 are electrically connected to each other and controlled by a same signal. The setting that the first light emitting control signal terminal ctrl1 and the second light emitting control signal terminal ctrl2 are electrically connected to each other and controlled by the same signal can reduce a number of wires for electrically connecting the pixel driving circuit to an external driving chip.

It should be noted that, referring to FIG. 3, since whether the sixth transistor is turned on does not affect the second electrode of the seventh transistor to output the driving signal in the fifth stage, therefore the sixth transistor may have same driving timing as the ninth transistor, that is, the first light emitting control signal received by the first light emitting control signal terminal ctrl1 and the second light emitting control signal received by the second light emitting control signal terminal ctrl2 have same timing. Of course, the sixth transistor may be controlled to be turned off in the fifth stage and turned on only in the sixth stage, in this case, the first light emitting control signal received by the first light emitting control signal terminal ctrl1 and the second light emitting control signal received by the second light emitting control signal terminal ctrl2 have different timing. If the sixth transistor and the ninth transistor have a same type, for example, the sixth transistor and the ninth transistor are both P-type transistors, the gate electrode of the sixth transistor may be electrically connected to the gate electrode of the ninth transistor according to the scheme shown in FIG. 12, that is, the first light emitting control signal terminal ctrl1 and the second light-emitting control signal terminal ctrl2 are electrically connected to each other, and connected to a same control signal line, which are controlled by a same signal.

On the basis of the foregoing embodiments, at least one of an active layer of the second transistor, an active layer of the third transistor, an active layer of the fourth transistor, an active layer of the fifth transistor, or an active layer of the sixth transistor is made of an indium gallium zinc oxide material. Since the second transistor, the third transistor, the fourth transistor, the fifth transistor, and the sixth transistor are all connected to a capacitor, a small leakage current is required to stably maintain a potential on a plate of the capacitor. Since a transistor with an active layer made of the indium gallium zinc oxide material, namely an IGZO transistor, which has advantages of a high carrier mobility, a fast response and a small leakage current, at least one of the active layer of the second transistor, the active layer of the third transistor, the active layer of the fourth transistor, the active layer of the fifth transistor or the active layer of the sixth transistor is made of the indium gallium zinc oxide material in the embodiments of the present disclosure. Since the P-type IGZO transistor has a high manufacturing difficulty, and a large-area manufacturing cannot be achieved at the present stage, in the embodiments of the present disclosure, at least one of the second transistor, the third transistor, the fourth transistor, the fifth transistor, and the sixth transistor is an N-type IGZO transistor. Other transistors in the pixel driving circuit may be low temperature polysilicon (LTPS) transistors. If the sixth transistor is the N-type IGZO transistor and the ninth transistor is a P-type LTPS transistor, the first light emitting control signal terminal ctrl1 and the second light emitting control signal terminal ctrl2 need to be controlled by different signals.

Figure 13:
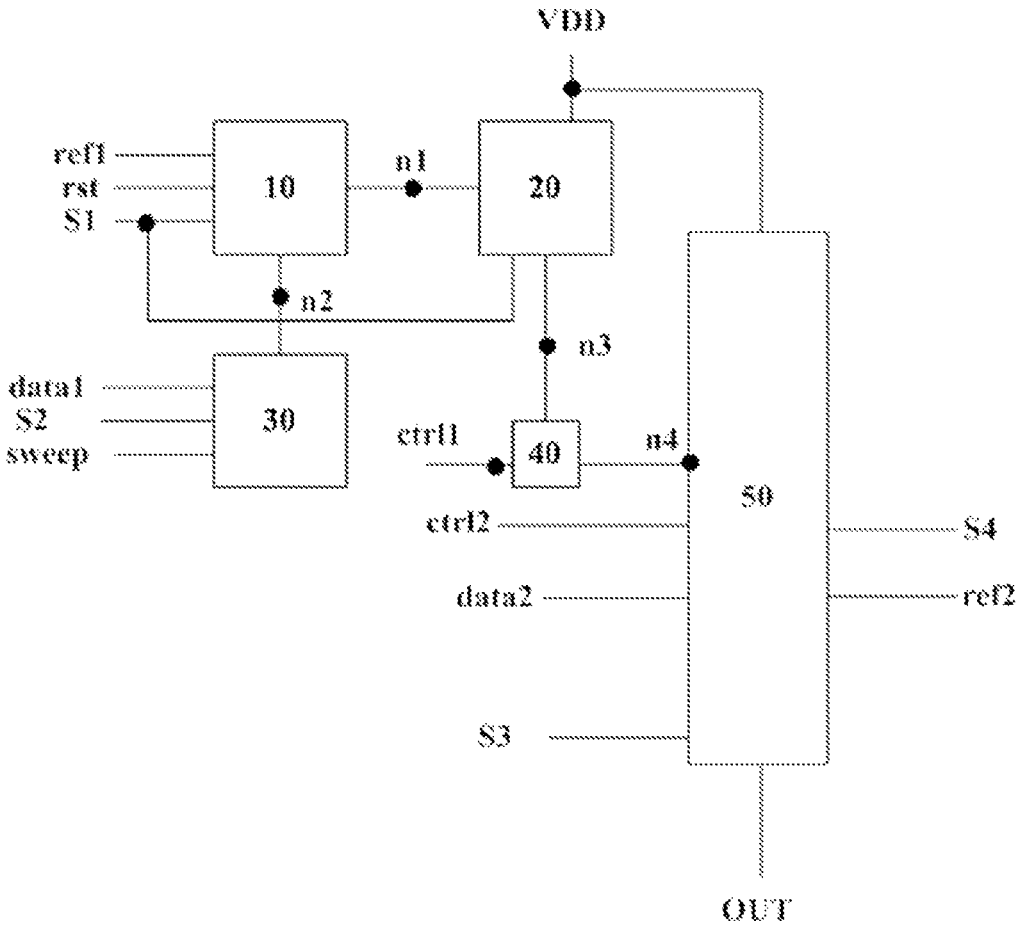
FIG. 13 is a structural diagram of another pixel driving circuit according to an embodiment of the present disclosure.

FIG. 13 is a structural diagram of another pixel driving circuit according to an embodiment of the present disclosure. FIG. 13 is based on the pixel driving circuit shown in FIG. 1, and the light emitting adjustment device further includes a fourth scanning signal terminal S4 and a second initialization signal terminal ref2.

The pixel driving circuit provided by the present embodiment of the present disclosure may be divided into a first sub-stage and a second sub-stage in the fourth stage. In the first sub-stage, the light emitting adjustment device is controlled by the third scanning signal input by the third scanning signal terminal S3 to write the second initialization signal of the second initialization signal terminal ref2 into the fourth node n4, so that the potential of the fourth node is n4=Vref2 and the fourth node n4 is reset. The interference to the driving process caused by the fact that the potential of the previous frame remained on the fourth node when the light emitting adjustment device emits light in a subsequent process is avoided. In the second sub-stage, a fourth scanning signal input by the fourth scanning signal terminal S4 controls the light emitting adjustment device to supply the second data signal to the fourth node by the second data signal terminal data2.

Figure 14:
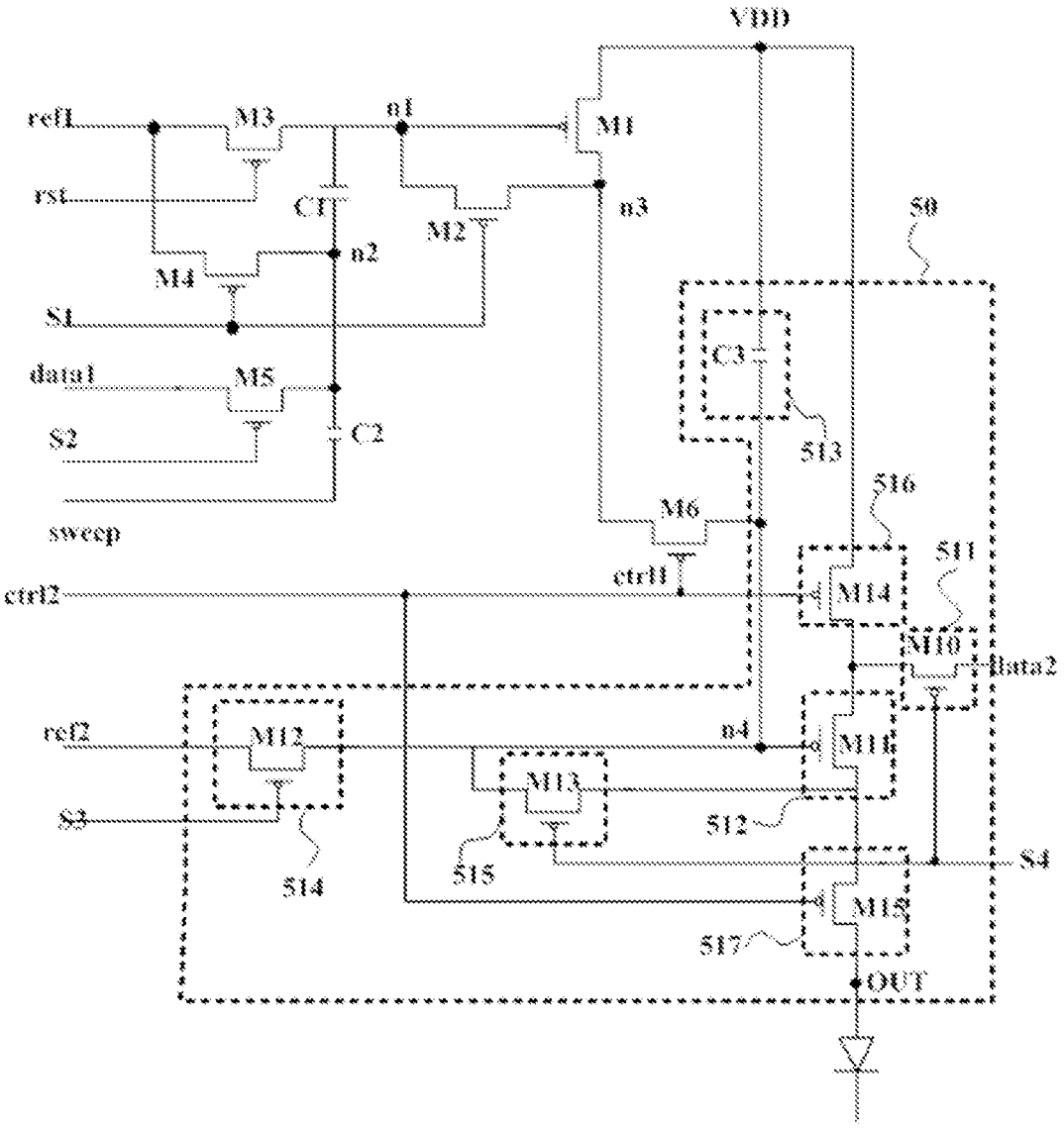
FIG. 14 is a structural diagram of another pixel driving circuit according to an embodiment of the present disclosure.

FIG. 14 is a structural diagram of another pixel driving circuit according to an embodiment of the present disclosure. This embodiment further provides another structure of the light emitting adjustment device, for example, the circuit structures of the above embodiments may be used for other devices in the pixel driving circuit, structures of the first initialization device, the first threshold compensation device, the first data writing device and the first light emitting control device in the pixel driving circuit are not limited in the embodiments of the present disclosure, and for convenience of describing the driving implementation process, the structures of the first initialization device, the first threshold compensation device, the first data writing device and the first light emitting control device in FIG. 14 are exemplarily set to be the same as structures in FIG. 3. Referring to FIG. 14, the light emitting adjustment device 50 provided by the embodiments of the present disclosure includes a second data writing device 511, a driving device 512, a storage device 513, a second initialization device 514, a second threshold compensation device 515, a second light emitting control device 516, and a third light emitting control device 517.

The second data writing device 514 includes the second initialization signal terminal ref2 and the third scanning signal terminal S3, and the second data writing device 514 is electrically connected to the fourth node n4. The storage device 513 is electrically connected between the first power signal terminal VDD and the fourth node n4. The second light emitting control device 516 includes the second light emitting control signal terminal ctrl2, and the second light emitting control device 516 is electrically connected to the first power signal terminal VDD and an input terminal of the driving device 512 respectively. The second data writing device 511 includes the second data signal terminal data2 and the fourth scanning signal terminal S4, and the second data writing device 511 is further electrically connected to the input terminal of the driving device 512. A control terminal of the driving device 512 is electrically connected to the fourth node n4, and the output terminal of the driving device is electrically connected to the third light emitting control device 517. The third light emitting control device 517 is further electrically connected to the second light emitting control signal terminal ctrl2, and an output terminal of the third light emitting control device 517 is the output terminal OUT of the light emitting adjustment device 50. The second threshold compensation device 514 is electrically connected between the output terminal of the driving device 512 and the fourth node n4, and the second threshold compensation device 514 is further electrically connected to the fourth scanning signal terminal S4.

Compared with the driving method of the pixel driving circuit corresponding to FIG. 1, the pixel driving circuit provided in the present embodiment of the present disclosure includes the first sub-stage and the second sub-stage in the fourth stage. In the first sub-stage of the fourth stage, the second initialization device 514 is used to be turned on under the control of the third scanning signal received by the third scanning signal terminal S3, and the second initialization signal of the second initialization signal terminal ref2 is written into the fourth node n4. In the second sub-stage of the fourth stage, the second data writing device 511 is used to be turned on under the control of the fourth scanning signal received by the fourth scanning signal terminal S4, and the second threshold compensation device 515 is also turned on under the control of the fourth scanning signal received by the fourth scanning signal terminal S4, completing data writing and compensation of the potential of the fourth node n4. In the fifth stage, the second light emitting control device 516 and the third light emitting control device 517 are turned on under the control of the second light emitting control signal received by the second light emitting control signal terminal ctrl2, and the driving device 512 outputs the driving signal to the light emitting element through the output terminal of the third light emitting control device 517, to drive the light emitting element to emit light.

The second data writing device 511 includes a tenth transistor M10. The driving device 512 includes an eleventh transistor M11. The second initialization device 514 includes a twelfth transistor M12. The second threshold compensation device 515 includes a thirteenth transistor M13. The second light emitting control device 516 includes a fourteenth transistor M14. The third light emitting control device 517 includes a fifteenth transistor M15. The storage device 513 includes a third capacitor C3. A first electrode of the tenth transistor M10 is electrically connected to the second data signal terminal data2, and a second electrode of the tenth transistor M10 and a first electrode of the eleventh transistor M11 are both electrically connected to a second electrode of the fourteenth transistor M14. A first electrode of the fourteenth transistor M14 is electrically connected to the first power signal terminal VDD, a first electrode of the fifteenth transistor M15 and a first electrode of the thirteenth transistor M13 are both electrically connected to a second electrode of the eleventh transistor M11, and a second electrode of the thirteenth transistor M13, a second electrode of the twelfth transistor M12, and a gate electrode of the eleventh transistor M11 are electrically connected to the fourth node n4. A first electrode of the twelfth transistor M12 is electrically connected to the second initialization signal terminal ref2, and a gate electrode of the twelfth transistor M12 is electrically connected to the third scanning signal terminal S3. A gate electrode of the thirteenth transistor M13 and a gate electrode of the tenth transistor M10 are both electrically connected to the fourth scanning signal terminal S4. A gate electrode of the fifteenth transistor M15 and a gate electrode of the fourteenth transistor M14 are both electrically connected to the second light emitting control signal terminal ctrl2. A second electrode of the fifteenth transistor M15 is the output terminal of the third light emitting control device 517, and the third capacitor C3 is electrically connected between the first power signal terminal VDD and the fourth node n4.

Figure 15:
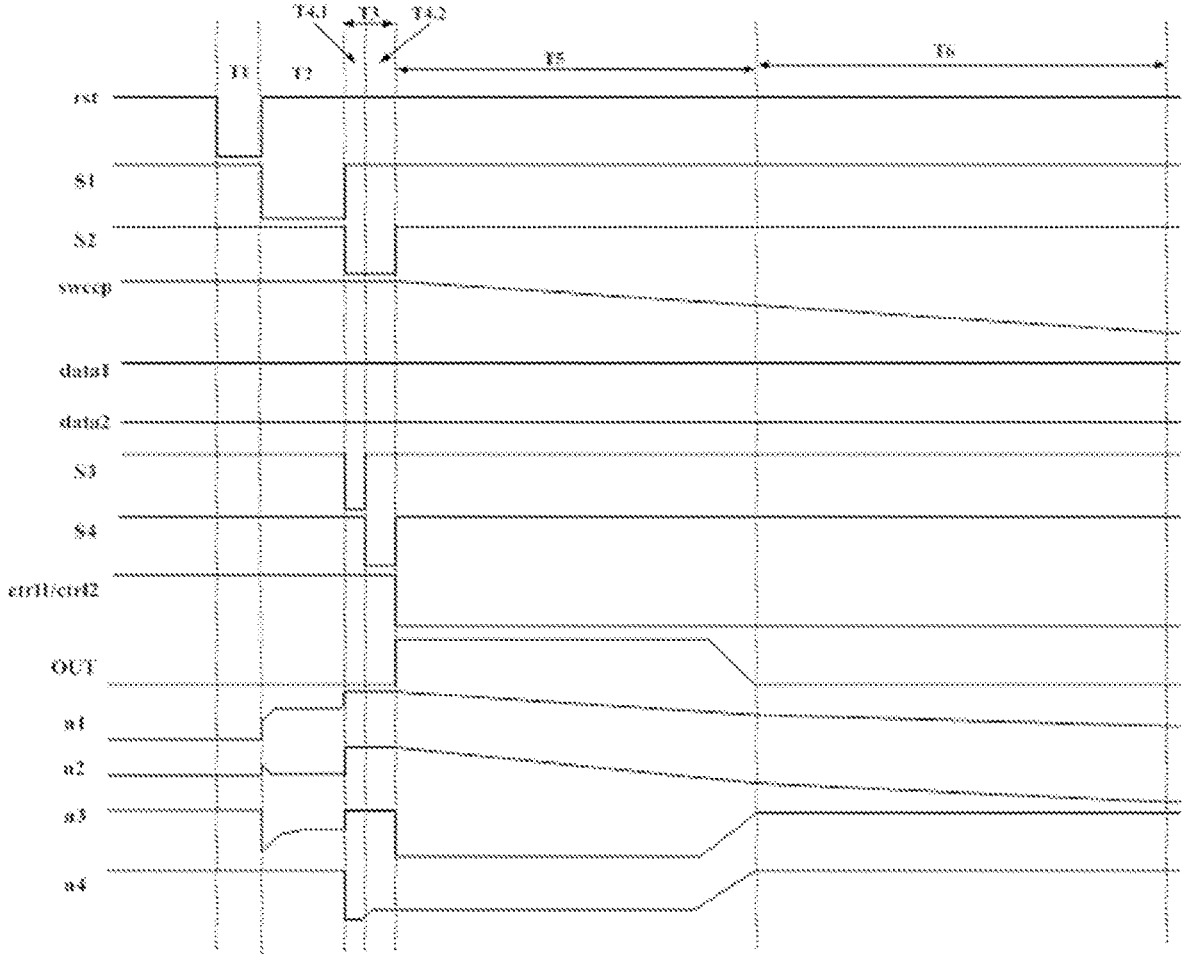
FIG. 15 is a driving timing diagram of the pixel driving circuit shown in FIG. 14.

FIG. 15 is a driving timing diagram of the pixel driving circuit shown in FIG. 14. In FIG. 14 and FIG. 15, exemplary descriptions are based on the example that each transistor of the pixel driving circuit is a P-type transistor.

Figure 16:
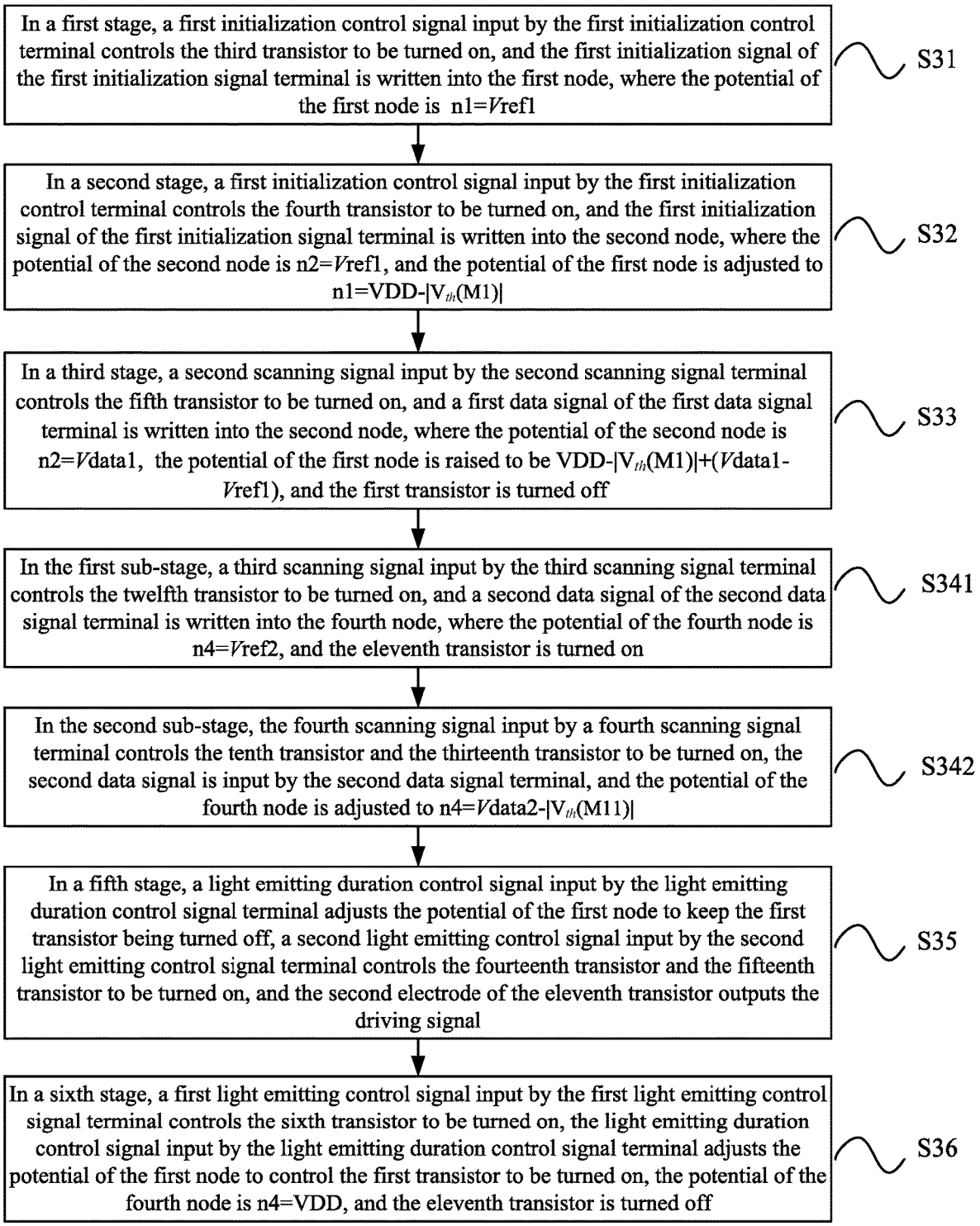
FIG. 16 is a flow diagram of a driving method for another pixel driving circuit according to an embodiment of the present disclosure.

FIG. 16 is a flow diagram of a driving method of another pixel driving circuit according to an embodiment of the present disclosure. Referring to FIG. 14 to FIG. 16, the driving method of the pixel driving circuit provided by the present disclosure includes steps described below.

S31, in a first stage, a first initialization control signal input by the first initialization control terminal controls the third transistor to be turned on, and the first initialization signal of the first initialization signal terminal is written into the first node, where the potential of the first node is n1=Vref1.

S32, in a second stage, a first initialization control signal input by the first initialization control terminal controls the fourth transistor to be turned on, the first initialization signal of the first initialization signal terminal is written into the second node, the potential of the second node is n2=Vref1, and the potential of the first node is adjusted to n1=VDD−$|V_{th}(M1)|$ S33, a third stage, a second scanning signal input by the second scanning signal terminal controls the fifth transistor to be turned on, a first data signal of the first data signal terminal is written into the second node, the potential of the second node is n2=Vref1, the potential of the first node is raised to VDD−$|V_{th}(M1)|$+(Vdata1−Vref1), and the first transistor is turned off.

The above stages are similar to the driving processes of S21 to S23, which will not be repeated herein.

The fourth stage in the method provided by the present embodiment includes the first sub-stage T4.1 and the second sub-stage T4.2.

S341, in the first sub-stage, a third scanning signal input by the third scanning signal terminal controls the twelfth transistor to be turned on, a second data signal of the second data signal terminal is written into the fourth node, the potential of the fourth nod is n4=Vref2, and the eleventh transistor is turned on.

Figure 17:
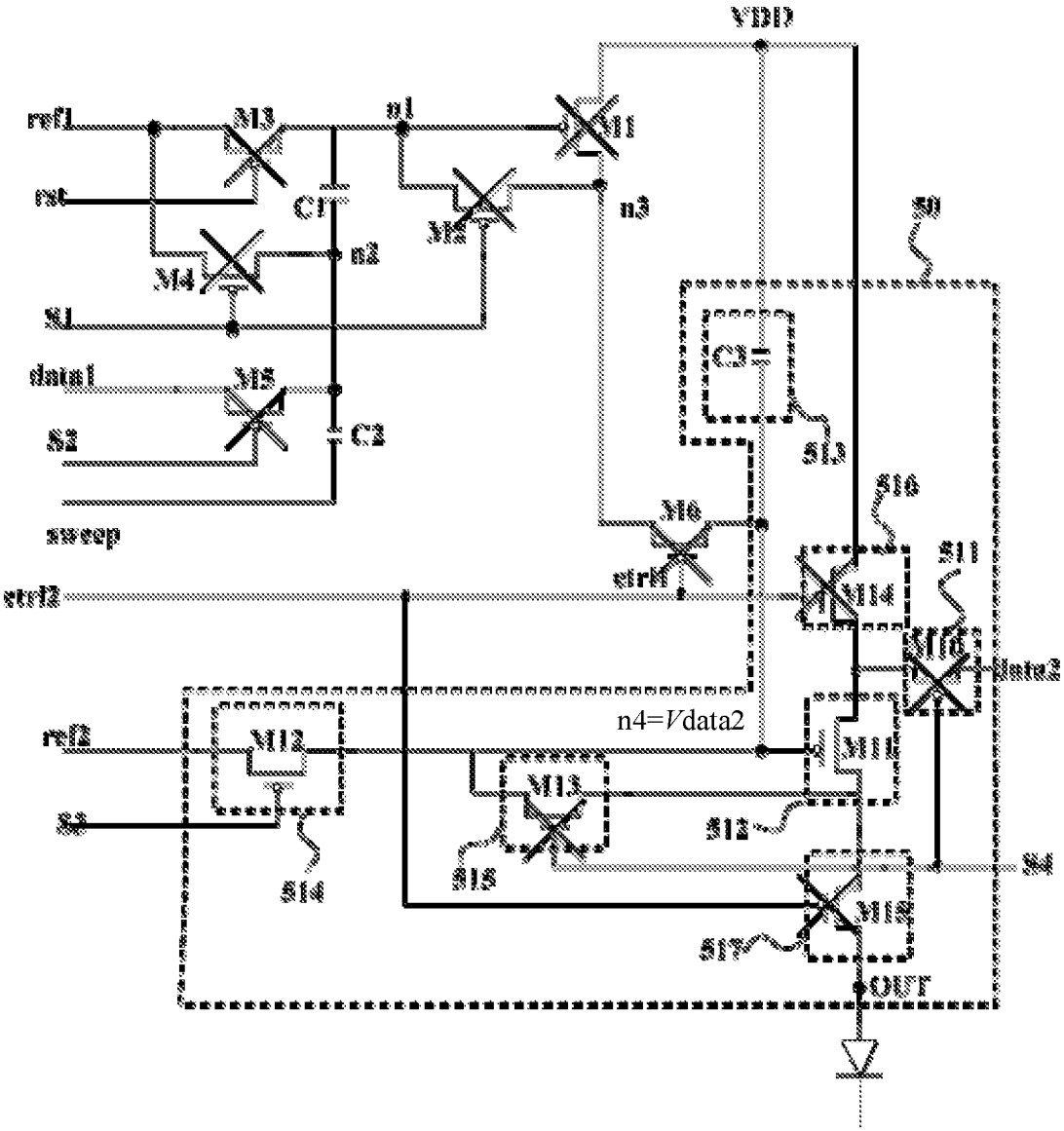
FIG. 17 is a schematic diagram illustrating on-state of each transistor of the pixel driving circuit in FIG. 14 in a first sub-stage.

On-state of each transistor in the pixel driving circuit in the first sub-stage T4.1 is referred to FIG. 17, the third scanning signal input by the third scanning signal terminal S3 is at a low level, and the twelfth transistor M12 is controlled to be turned on. The twelfth transistor M12 writes the second initialization signal of the second initialization signal terminal ref2 into the fourth node n4, the potential of the fourth node is n4=Vref2, and the eleventh transistor M11 is turned on.

S342, in the second sub-stage, a fourth scanning signal input by the fourth scanning signal terminal controls the tenth transistor and the thirteenth transistor to be turned on, the second data signal is input by the second data signal terminal, and the potential of the fourth node is adjusted to n4=Vdata2−$|V_{th}(M11)|$.

Figure 18:
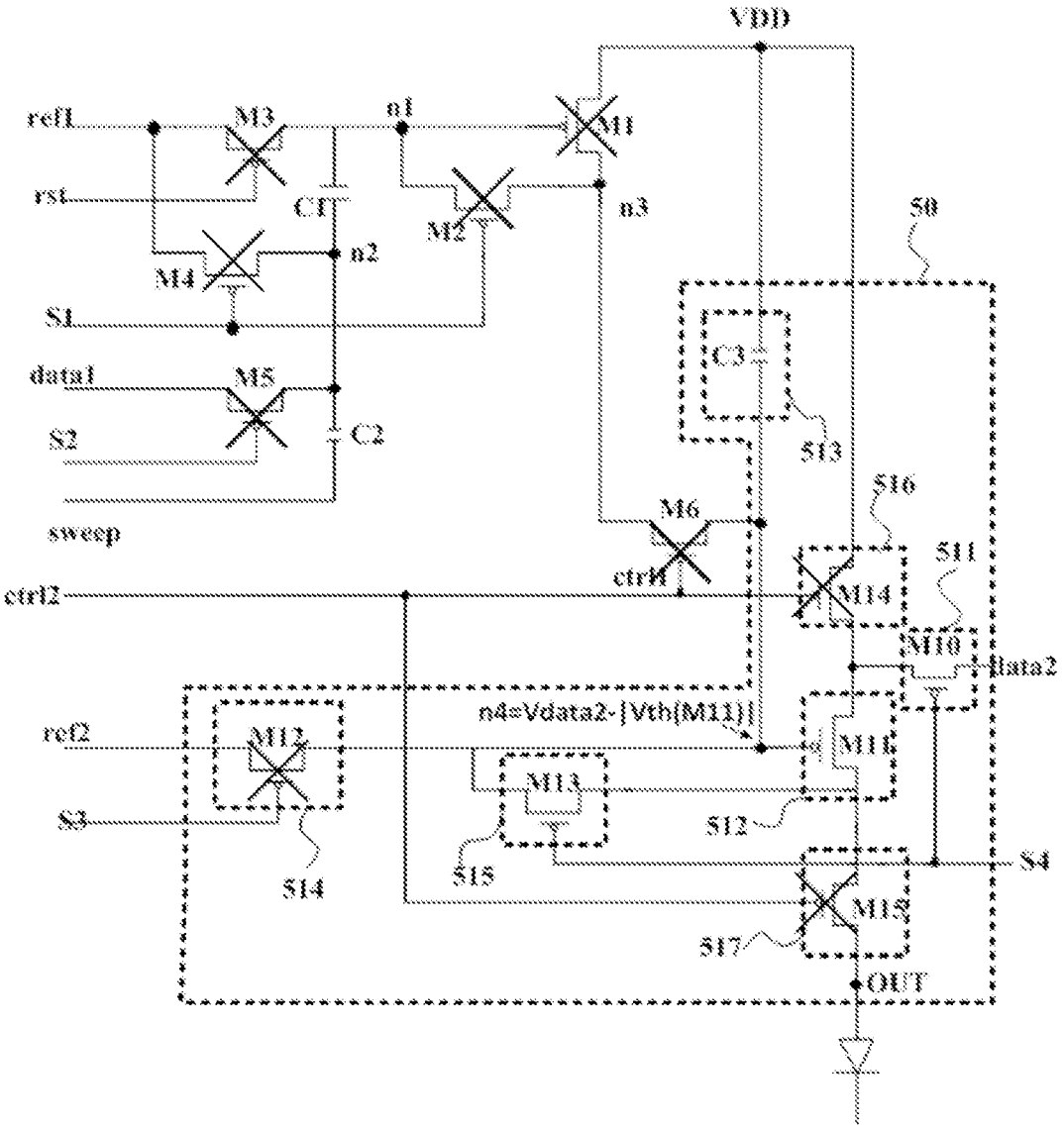
FIG. 18 is a schematic diagram illustrating on-state of each transistor of the pixel driving circuit in FIG. 14 in a second sub-stage.

On-off state of each transistor in the pixel driving circuit in the second sub-stage T4.2 is referred to FIG. 18, the fourth scanning signal input by the fourth scanning signal terminal S4 is at a low level, and the tenth transistor M10 and the thirteenth transistor M13 are controlled to be turned on. Since the eleventh transistor M11 is also turned on, the second data signal terminal data2 provides the second data signal to the fourth node n4. The thirteenth transistor M13 compensates a threshold voltage of the eleventh transistor 11 to the fourth node n4, so that the driving current generated by the eleventh transistor 11 is unrelated to the threshold voltage, and the influence of threshold voltage fluctuation of the eleventh transistor M11 on the light emitting brightness of the light emitting element is avoided. The potential of the fourth node is n4=Vdata2−$|V_{th}(M11)|$.

S35, in a fifth stage, a light emitting duration control signal input by the light emitting duration control signal terminal adjusts the potential of the first node to keep the first transistor being turned off, a second light emitting control signal input by the second light emitting control signal terminal controls the fourteenth transistor and the fifteenth transistor to be turned on, and the second electrode of the eleventh transistor outputs the driving signal.

Figure 19:
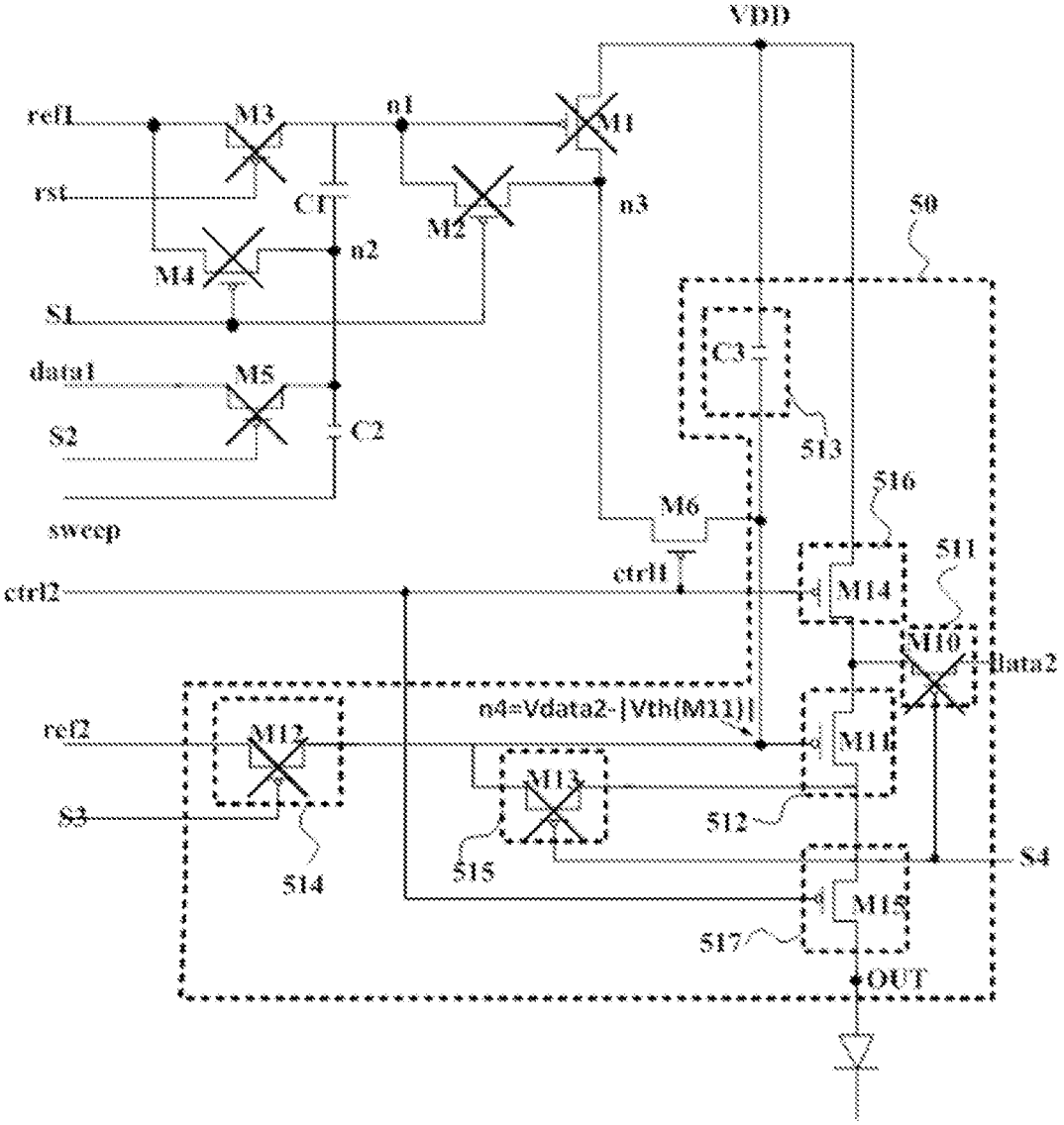
FIG. 19 is a schematic diagram illustrating on-state of each transistor of the pixel driving circuit in FIG. 14 in a fifth stage.

On-state of each transistor in the pixel driving circuit in the fifth stage T5 is referred to FIG. 19, the light emitting duration control signal input by the light emitting duration control signal terminal sweep adjusts the potential of the first node n1. Although in the fifth stage, the light emitting duration control signal continues to fall, which causes the potential of the first node n1 to fall, but the potential of the first node n1 is always greater than VDD−$|V_{th}(M1)|$ in the fifth stage, thus the first transistor M1 still remains off. In this stage, the second light emitting control signal input by the second light emitting control signal terminal ctrl2 controls the fourteenth transistor M14 and the fifteenth transistor M15 to be turned on. Since the eleventh transistor M11 is also turned on at this time, the second electrode of the eleventh transistor M11 outputs the driving signal, so that the light emitting element can be driven to emit light. In this stage, since the magnitude of the driving signal for driving the light emitting elements to emit light is related to the second data signal data2, pixel driving circuits correspondingly connected to all light emitting elements of a same color can be controlled, and second data signals input in this stage are same, implementing chromaticity uniformity of all light emitting elements of the same color. In addition, light emitting brightness of the light emitting elements can be controlled through the duration of the fifth stage, and the duration of the fifth stage is controlled by the first data signal and the light emitting duration control signal, so that light emitting brightness of each light emitting element can be controlled through the first data signal and the light emitting duration control signal according to display requirements.

S36, in a sixth stage, a first light emitting control signal input by the first light emitting control signal terminal controls the sixth transistor to be turned on, the light emitting duration control signal input by the light emitting duration control signal terminal adjusts the potential of the first node to control the first transistor to be turned on, the potential of the fourth node is n4=VDD and the eleventh transistor is turned off.

Figure 20:
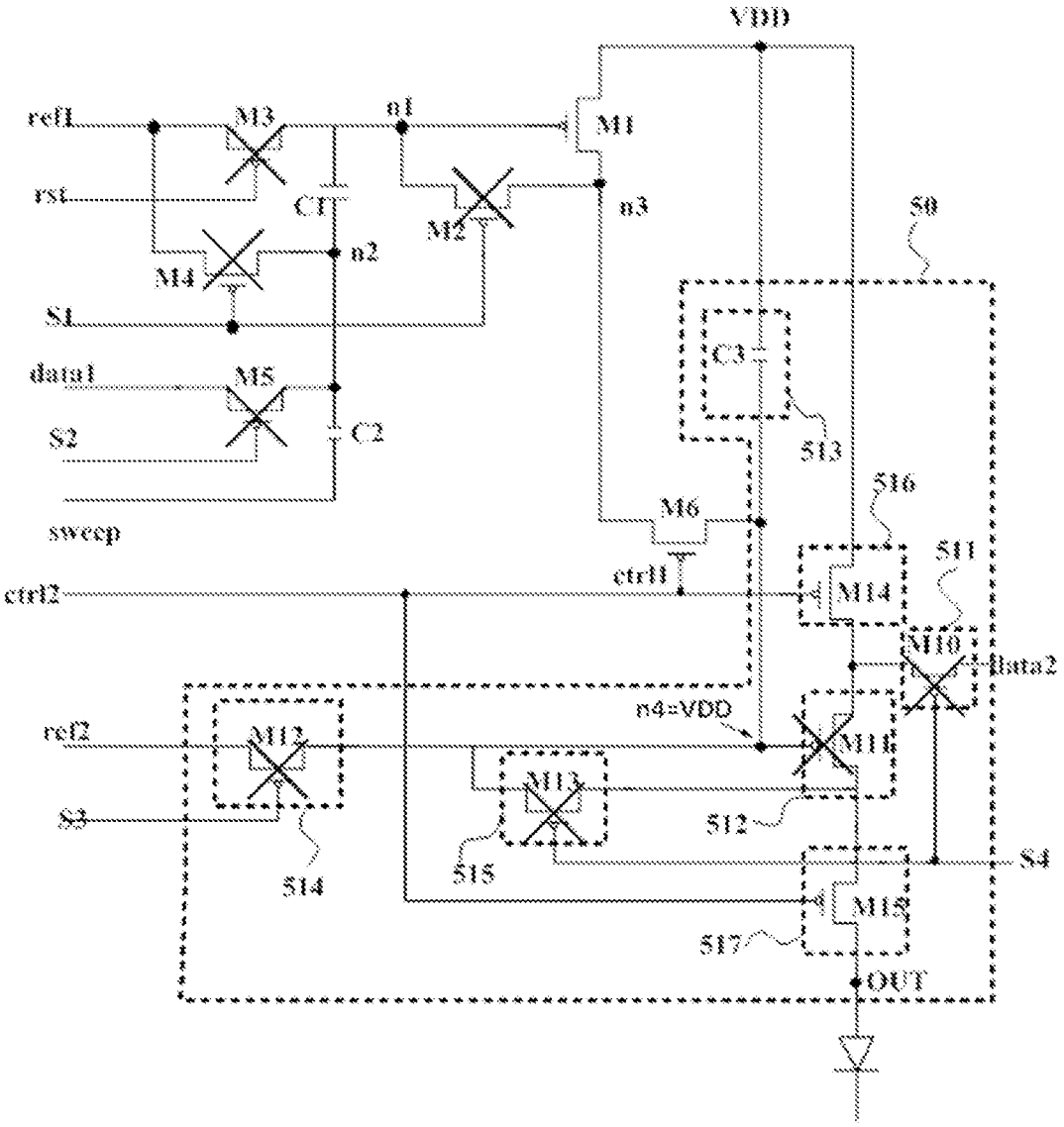
FIG. 20 is a schematic diagram illustrating on-state of each transistor of the pixel driving circuit in FIG. 14 in a sixth stage.

On-state of each transistor in the pixel driving circuit in the six stage T6 is referred to FIG. 20, the first light emitting control signal input by the first light emitting control signal terminal ctrl1 controls the sixth transistor M6 to be turned on, the light emitting duration control signal input by the light emitting duration control signal terminal sweep adjusts the potential of the first node, when the potential of the first node drops to n1=VDD−$|V_{th}(M1)|$, the first transistor M1 is in a critical on state, that is, the first transistor M1 is turned on at the beginning of the sixth stage. The first power signal terminal VDD writes the first power signal into the fourth node n4 through the first transistor M1 and the sixth transistor M6, the potential of the fourth node is n4=VDD, the eleventh transistor M11 is turned off, and the second electrode of the eleventh transistor M11 stops outputting the driving signal. Therefore, the light emitting element electrically connected to the second electrode of the fifteenth transistor M15 stops emitting light.

Where, ref1 is the first initialization signal, VDD is the first power signal, $V_{th}(M1)$ is the threshold voltage of the first transistor, data1 is the first data signal, ref2 is the second initialization signal, $V_{th}(M11)$ is the threshold voltage of the eleventh transistor, and data2 is the second data signal.

It should be noted that, since the driving process of the third stage and driving processes of the first sub-stage and the second sub-stage in the fourth stage do not conflict, that is, the driving processes of the first sub-stage and the second sub-stage may also be executed during the third stage, the third stage may also overlap with the first sub-stage and the second sub-stage. As shown in FIG. 15, it is set that the first sub-stage T4.1 and the second sub-stage T4.2 are executed in the third stage T3, which is not limited to the embodiments of the present disclosure.

On the basis of the foregoing embodiments, an active layer of the twelfth transistor M12 is made of an indium gallium zinc oxide material. The second electrode of the twelfth transistor M12 is electrically connected to the third capacitor C3, so to stably maintain a potential on a plate of the third capacitor, an IGZO transistor with a small leakage current, that is, a transistor with an active layer made of the indium gallium zinc oxide material is selected as the twelfth transistor M12.

It should be noted that the first light emitting control signal terminal ctrl1 is exemplarily set to be electrically connected to the second light emitting control signal terminal ctrl2 in FIG. 14. If the sixth transistor and the fourteenth transistor have a same type, for example, the sixth transistor and the fourteenth transistor are P-type transistors, the first light emitting control signal terminal ctrl1 and the second light emitting control signal terminal ctrl2 may be set to be electrically connected to each other and controlled by a same signal. If the sixth transistor and the fourteenth transistor have different types, the first light emitting control signal terminal ctrl1 and the second light emitting control signal terminal ctrl2 need to be set to be controlled by different signals.

Figure 21:
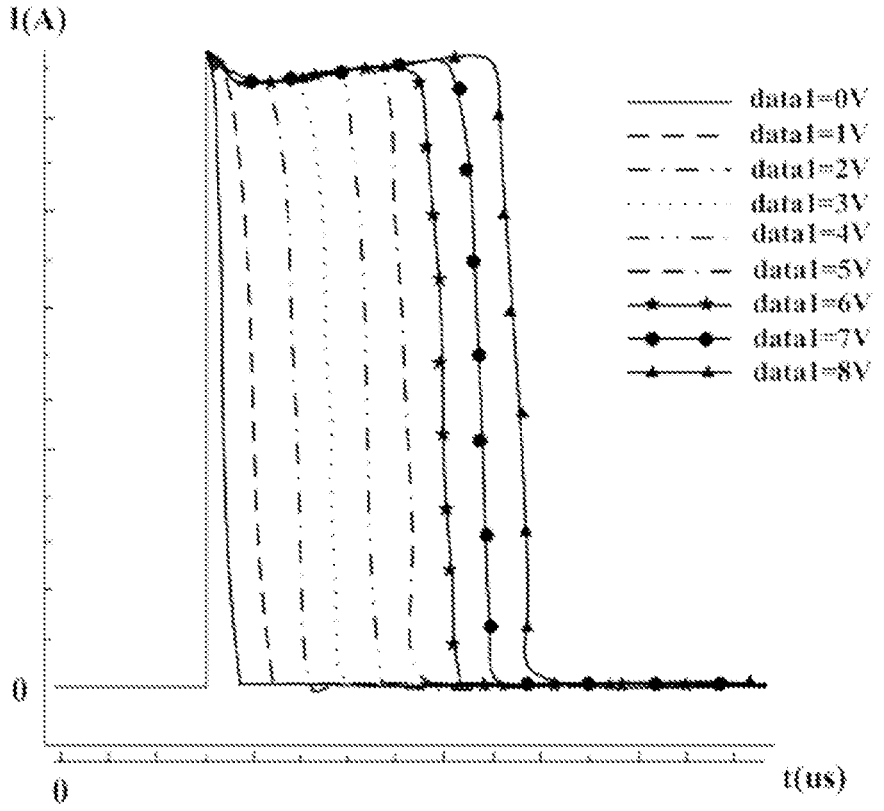
FIG. 21 is a diagram illustrating simulation effects according to an embodiment of the present disclosure.

FIG. 21 is a graph illustrating simulation effects according to an embodiment of the present disclosure, it is shown by simulation tests that when the first data signal data1 changes from 0V to 8V with a fixed second data signal data2, the driving signal (a driving current I) output by the pixel driving circuit basically remains unchanged. Duration t of the driving signal output by the pixel driving circuit gradually increases while the first data signal data1 becomes larger. Therefore, it is theoretically verified that controlling light emitting duration of the light emitting elements can be implemented by adjusting the magnitude of the first data signal data1.

Figure 22:
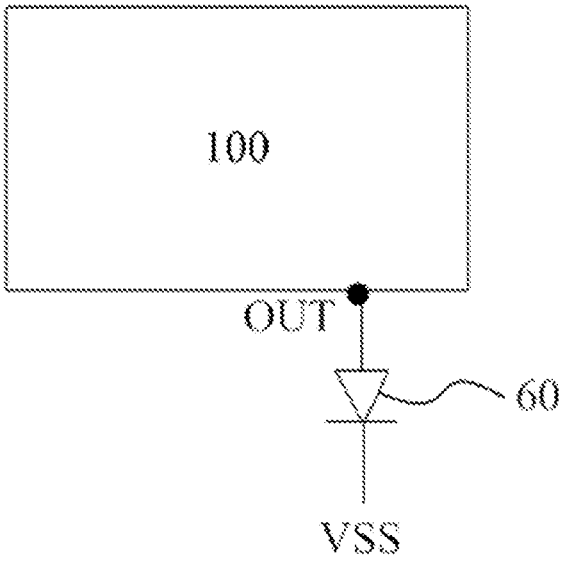
FIG. 22 is a structural diagram of a display panel according to an embodiment of the present disclosure.

An embodiment of the present disclosure further provides a display panel, FIG. 22 is a structural diagram of the display panel according to the embodiments of the present disclosure. As shown in FIG. 22, the display panel includes a light emitting element 60 and the pixel driving circuit 100 according to any one of the above embodiments. Where, the output terminal OUT of the pixel driving circuit 100 is electrically connected to an anode of the light emitting element 60. A cathode of the light emitting element 60 is electrically connected to a second power signal terminal VSS. Therefore, the display panel provided by the present embodiment of the present disclosure also has the advantages described in the above embodiments, and details are not repeated herein. Exemplarily, the display panel may include a mobile phone, a tablet computer, a smart wearable device (such as a smart watch) and etc., and no limitations are made thereto in the embodiments of the present disclosure.

On the basis of the above embodiments, if a part of transistors in the pixel driving circuit 100 of the display panel are LTPS transistors and other part of the transistors are IGZO transistors, then an active layer of an IGZO transistor and an active layer of an LTPS transistor may be overlapped on a space projection. An overlapped setting of the active layer of the IGZO transistor and the active layer of the LTPS transistor on the space projection can save space occupied by each transistor in the display panel, which is beneficial to improving an aperture opening ratio and a resolution of the display panel.

Figure 23:
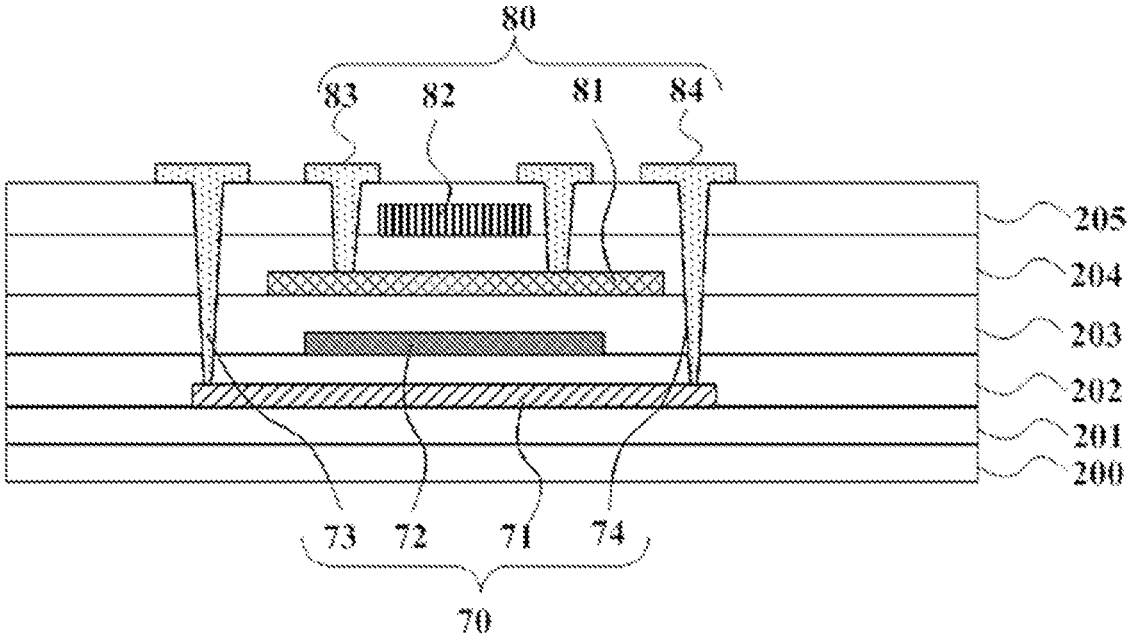
FIG. 23 is a partial cross-sectional view of a display panel according to an embodiment of the present disclosure.

FIG. 23 is a partial cross-sectional view of a display panel according to an embodiment of the present disclosure. Referring to FIG. 23, the display panel includes a substrate 200, and at least one LTPS transistor 70 and at least one IGZO transistor 80 disposed on the substrate 200. Where, the LTPS transistor 70 includes a first active layer 71, and the IGZO transistor 80 includes a second active layer 81. A vertical projection of the first active layer 71 on the substrate 200 at least partially overlaps a vertical projection of the second active layer 81 on the substrate 200. In addition, the LTPS transistor 70 further includes a first gate electrode 72, a first source electrode 73, and a first drain electrode 74. The IGZO transistor 80 further includes a second gate electrode 82, a second source electrode 83, and a second drain electrode 84. The display panel further includes a first insulating layer 201, a second insulating layer 202, a third insulating layer 203, a fourth insulating layer 204, and a fifth insulating layer 205, which are all disposed on the substrate 200. The first active layer 71 is disposed on a side of the first insulating layer 201 facing away from the substrate 200. The second insulating layer 202 is disposed on a side of the first active layer 71 facing away from the substrate 200. The first gate electrode 72 is disposed on a side of the second insulating layer 202 facing away from the substrate 200. The third insulating layer 203 is disposed on a side of the first gate electrode 72 facing away from the substrate 200. The second active layer 81 is disposed on a side of the third insulating layer 203 facing away from the substrate 200. The fourth insulating layer 204 is disposed on a side of the second active layer 81 facing away from the substrate 200. The second gate electrode 82 is disposed on a side of the fourth insulating layer 204 facing away from the substrate 200. The fifth insulating layer 205 is disposed on a side of the second gate electrode 82 facing away from the substrate 200. The first source electrode 73, the first drain electrode 74, the second source electrode 83, and the second drain electrode 84 are disposed on the fifth insulating layer 205, the first source electrode 73 and the first drain electrode 74 are connected to the first active layer 71 via a through-hole, and the second source electrode 83 and the second drain electrode 84 are connected to the second active layer 81 via a through-hole.

Figure 24:
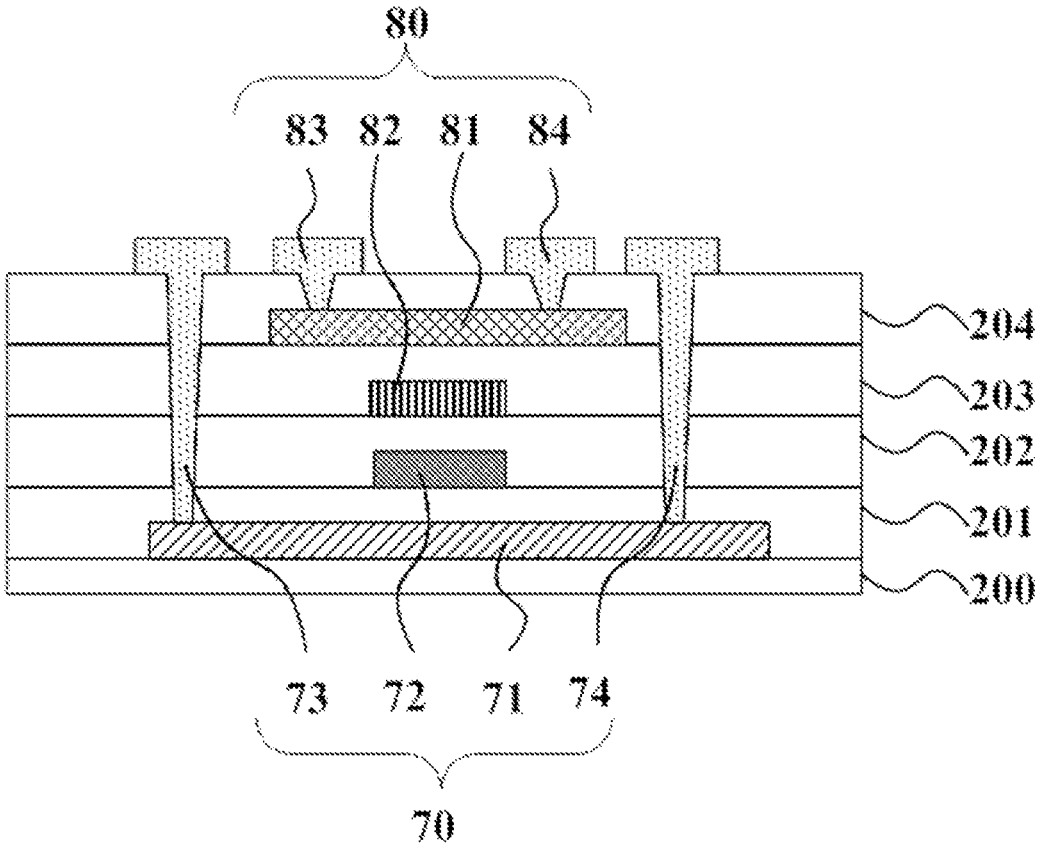
FIG. 24 is a partial cross-sectional view of another display panel according to an embodiment of the present disclosure.

FIG. 24 is a partial cross-sectional view of another display panel according to an embodiment of the present disclosure. Referring to FIG. 24, the display panel includes a substrate 200, and at least one LTPS transistor 70 and at least one IGZO transistor 80 on the substrate 200. The LTPS transistor 70 includes a first active layer 71, and the IGZO transistor 80 includes a second active layer 81. A vertical projection of the first active layer 71 on the substrate 200 at least partially overlaps a vertical projection of the second active layer 81 on the substrate 200. In addition, the LTPS transistor 70 further includes a first gate electrode 72, a first source electrode 73, and a first drain electrode 74. The IGZO transistor 80 further includes a second gate electrode 82, a second source electrode 83, and a second drain electrode 84. The display panel further includes a first insulating layer 201, a second insulating layer 202, a third insulating layer 203, and a fourth insulating layer 204, which are all disposed on the substrate 200. The first insulating layer 201 is disposed on a side of the first active layer 71 facing away from the substrate 200. The first gate electrode 71 is disposed on a side of the first insulating layer facing away from the substrate 200. The second insulating layer 202 is disposed on a side of the first gate electrode 72 facing away from the substrate. The second gate electrode 82 is disposed on a side of the second insulating layer 202 facing away from the substrate 200. The third insulating layer 203 is disposed on a side of the second gate electrode 82 facing away from the substrate 200. The second active layer 81 is disposed on a side of the third insulating layer 203 facing away from the substrate, and the fourth insulating layer 204 is disposed on a side of the second active layer 81 facing away from the substrate 200. The first source electrode 73, the first drain electrode 74, the second source electrode 83, and the second drain electrode 84 are disposed on the fourth insulating layer 204, the first source electrode 73 and the first drain electrode 74 are connected to the first active layer 71 via a through-hole, and the second source electrode 83 and the second drain electrode 84 are connected to the second active layer 81 via a through-hole.

What is claimed is:

1. A pixel driving circuit, comprising:

a first initialization device, a first threshold compensation device, a first data writing device, a first light emitting control device and a light emitting adjustment device; wherein:

the first initialization device comprises a first initialization signal terminal, a first initialization control terminal and a first scanning signal terminal, the first initialization device is electrically connected to a first node and a second node, and the first initialization device provides a first initialization signal to the first node;

the first threshold compensation device comprises a first power signal terminal, the first threshold compensation device is electrically connected to the first scanning signal terminal, the first node and a third node, and the first threshold compensation device is used for compensating a potential of the first node;

the first data writing device comprises a first data signal terminal, a second scanning signal terminal and a light emitting duration control signal terminal, the first data writing device is electrically connected to the second node, and the first data writing device adjusts the potential of the first node through the second node;

the first light emitting control device comprises a first light emitting control signal terminal, and the first light emitting control device is electrically connected to the third node and a fourth node; and the light emitting adjustment device comprises a second light emitting control signal terminal, a third scanning signal terminal, a second data signal terminal and an output terminal, the light emitting adjustment device is electrically connected to the first power signal terminal and the fourth node, and the light emitting adjustment device outputs a driving signal through the output terminal.

2. The pixel driving circuit of claim 1, wherein the first threshold compensation device comprises a first transistor and a second transistor;

a first electrode of the first transistor is electrically connected to the first power signal terminal, a second electrode of the first transistor and a first electrode of the second transistor are electrically connected to the third node, a gate electrode of the first transistor and a second electrode of the second transistor are electrically connected to the first node, and a gate electrode of the second transistor is electrically connected to the first scanning signal terminal.

3. The pixel driving circuit of claim 1, wherein the first initialization device comprises a third transistor, a fourth transistor and a first capacitor;

each of a first electrode of the third transistor and a first electrode of the fourth transistor is electrically connected to the first initialization signal terminal, each of a second electrode of the third transistor and a first plate of the first capacitor is electrically connected to the first node, a gate electrode of the third transistor is electrically connected to the first initialization control terminal, each of a second electrode of the fourth transistor and a second plate of the first capacitor is electrically connected to the second node, and a gate electrode of the fourth transistor is electrically connected to the first scanning signal terminal.

4. The pixel driving circuit of claim 1, wherein the first data writing device comprises a fifth transistor and a second capacitor;

a first electrode of the fifth transistor is electrically connected to the first data signal terminal, each of a second electrode of the fifth transistor and a first plate of the second capacitor is electrically connected to the second node, a gate electrode of the fifth transistor is electrically connected to the second scanning signal terminal, and a second plate of the second capacitor is electrically connected to the light emitting duration control signal terminal.

5. The pixel driving circuit of claim 1, wherein the first light emitting control device comprises a sixth transistor, a gate electrode of the sixth transistor is electrically connected to the first light emitting control signal terminal, a first electrode of the sixth transistor is electrically connected to the third node, and a second electrode of the sixth transistor is electrically connected to the fourth node.

6. The pixel driving circuit of claim 1, wherein the light emitting adjustment device comprises a second data writing device, a driving device, a storage device and a second light emitting control device; wherein:

the second data writing device comprises the second data signal terminal and the third scanning signal terminal; and the second data writing device is electrically connected to the fourth node;

an output terminal of the driving device is an output terminal of the light emitting adjustment device; and a control terminal of the driving device is electrically connected to the fourth node;

the second light emitting control device comprises the second light emitting control signal terminal; and the second light emitting control device is electrically connected between the first power signal terminal and an input terminal of the driving device; and the storage device is electrically connected between the first power signal terminal and the fourth node.

7. The pixel driving circuit of claim 6, wherein the driving device comprises a seventh transistor; the second data writing device comprises an eighth transistor; the second light emitting control device comprises a ninth transistor; and the storage device comprises a third capacitor;

wherein a first electrode of the seventh transistor is electrically connected to a second electrode of the ninth transistor, a second electrode of the seventh transistor is the output terminal of the driving device, a first electrode of the ninth transistor is electrically connected to the first power signal terminal, a gate electrode of the ninth transistor is electrically connected to the first light emitting control signal terminal, a first electrode of the eighth transistor is electrically connected to the second data signal terminal, each of a second electrode of the eighth transistor and a gate electrode of the seventh transistor is electrically connected to the fourth node, a gate electrode of the eighth transistor is electrically connected to the third scanning signal terminal, and the third capacitor is electrically connected between the first power signal terminal and the fourth node.

8. The pixel driving circuit of claim 2, wherein an active layer of the second transistor is made of an indium gallium zinc oxide material.

9. The pixel driving circuit of claim 3, wherein at least one of an active layer of the third transistor or an active layer of the fourth transistor is made of an indium gallium zinc oxide material.

10. The pixel driving circuit of claim 1, wherein the first light emitting control signal terminal and the second light emitting control signal terminal are electrically connected to each other and controlled by a same signal.

11. The pixel driving circuit of claim 1, wherein the light emitting adjustment device further comprises a fourth scanning signal terminal and a second initialization signal terminal.

12. The pixel driving circuit of claim 11, wherein the light emitting adjustment device comprises a second data writing device, a driving device, a storage device, a second initialization device, a second threshold compensation device, a second light emitting control device, and a third light emitting control device; wherein:

the second initialization device comprises the second initialization signal terminal and the third scanning signal terminal; and the second initialization device is electrically connected to the fourth node;

the storage device is electrically connected between the first power signal terminal and the fourth node;

the second light emitting control device comprises the second light emitting control signal terminal; and the second light emitting control device is electrically connected to the first power signal terminal and an input terminal of the driving device respectively;

the second data writing device comprises the second data signal terminal and the fourth scanning signal terminal; and the second data writing device is further electrically connected to the input terminal of the driving device;

a control terminal of the driving device is electrically connected to the fourth node; and the output terminal of the driving device is electrically connected to the third light emitting control device;

the third light emitting control device is further electrically connected to the second light emitting control signal terminal; and an output terminal of the third light emitting control device is an output terminal of the light emitting adjustment device; and the second threshold compensation device is electrically connected between the output terminal of the driving device and the fourth node; and the second threshold compensation device is further electrically connected to the fourth scanning signal terminal.

13. The pixel driving circuit of claim 12, wherein the second data writing device comprises a tenth transistor; the driving device comprises an eleventh transistor; the second initialization device comprises a twelfth transistor; the second threshold compensation device comprises a thirteenth transistor; the second light emitting control device comprises a fourteenth transistor; the third light emitting control device comprises a fifteenth transistor; and the storage device comprises a third capacitor; wherein a first electrode of the tenth transistor is electrically connected to the second data signal terminal, each of a second electrode of the tenth transistor and a first electrode of the eleventh transistor is electrically connected to a second electrode of the fourteenth transistor, a first electrode of the fourteenth transistor is electrically connected to the first power signal terminal, each of a first electrode of the fifteenth transistor and a first electrode of the thirteenth transistor is electrically connected to a second electrode of the eleventh transistor, each of a second electrode of the thirteenth transistor, a second electrode of the twelfth transistor and a gate electrode of the eleventh transistor is electrically connected to the fourth node, a first electrode of the twelfth transistor is electrically connected to the second initialization signal terminal, a gate electrode of the twelfth transistor is electrically connected to the third scanning signal terminal, each of a gate electrode of the thirteenth transistor and a gate electrode of the tenth transistor is electrically connected to the fourth scanning signal terminal, each of a gate electrode of the fifteenth transistor and a gate electrode of the fourteenth transistor is electrically connected to the second light emitting control signal terminal, a second electrode of the fifteenth transistor is an output terminal of the third light emitting control device, and the third capacitor is electrically connected between the first power signal terminal and the fourth node.

14. The pixel driving circuit of claim 13, wherein an active layer of the twelfth transistor is made of an indium gallium zinc oxide material.

15. A display panel, comprising:

a light emitting element and a pixel driving circuit;

wherein the pixel driving circuit comprises: a first initialization device, a first threshold compensation device, a first data writing device, a first light emitting control device and a light emitting adjustment device; wherein:

the first initialization device comprises a first initialization signal terminal, a first initialization control terminal and a first scanning signal terminal, the first initialization device is electrically connected to a first node and a second node, and the first initialization device provides a first initialization signal to the first node;

the first threshold compensation device comprises a first power signal terminal, the first threshold compensation device is electrically connected to the first scanning signal terminal, the first node and a third node, and the first threshold compensation device is used for compensating a potential of the first node;

the first data writing device comprises a first data signal terminal, a second scanning signal terminal and a light emitting duration control signal terminal, the first data writing device is electrically connected to the second node, and the first data writing device adjusts the potential of the first node through the second node;

the first light emitting control device comprises a first light emitting control signal terminal, and the first light emitting control device is electrically connected to the third node and a fourth node; and the light emitting adjustment device comprises a second light emitting control signal terminal, a third scanning signal terminal, a second data signal terminal and an output terminal, the light emitting adjustment device is electrically connected to the first power signal terminal and the fourth node, and the light emitting adjustment device outputs a driving signal through the output terminal; and wherein the output terminal of the pixel driving circuit is electrically connected to an anode of the light emitting element.

16. A driving method of a pixel driving circuit, operating the pixel driving circuit of claim 1, comprising:

operating, in a first stage, the first initialization device to write the first initialization signal of the first initialization signal terminal into the first node;

operating, in a second stage, the first threshold compensation device to compensate the potential of the first node and the first initialization device to write the first initialization signal of the first initialization signal terminal into the second node;

operating, in a third stage, the first data writing device to write a first data signal of the first data signal terminal into the second node;

operating, in a fourth stage, the light emitting adjustment device write a second data signal of the second data signal terminal into the fourth node;

operating, in a fifth stage, the first data writing device to adjust the potential of the first node to disconnect a connection between the first power signal terminal and the third node and the light emitting adjustment device to output the driving signal through the output terminal; and turning on, in a sixth stage, the first light emitting control device, operating the first data writing device to adjust the potential of the first node, wherein the connection between the first power signal terminal and the third node is conductive, and an output terminal of the light emitting adjustment device is turned off.

17. The driving method of claim 16, wherein:

the first stage comprises: controlling a third transistor comprised in the first initialization device to be turned on by a first initialization control signal input by the first initialization control terminal, and writing the first initialization signal of the first initialization signal terminal into the first node, wherein the potential of the first node is n1=Vref1; and the second stage comprises: controlling a fourth transistor comprised in the first initialization device and a second transistor comprised in the first threshold compensation device to be turned on by a first scanning signal input by the first scanning signal terminal, and writing the first initialization signal of the first initialization signal terminal into the second node, wherein a potential of the second node is n2=Vref1, and the potential of the first node is adjusted to n1=VDD−$|V_{th}$(M1)|;

wherein ref1 is the first initialization signal, VDD is a first power signal, and $V_{th}$(M1) is a threshold voltage of a first transistor comprised in the first threshold compensation device.

18. The driving method of claim 16, wherein:

the third stage comprises: controlling a fifth transistor comprised in the first data writing device to be turned on by a second scanning signal input by the second scanning signal terminal, and writing the first data signal of the first data signal terminal into the second node; wherein a potential of the second node is n2=Vdata1, the potential of the first node is raised to be VDD−$|V_{th}$(M1)|+(Vdata1−Vref1), and a first transistor comprised in the first threshold compensation device is turned off; and the fourth stage comprises: controlling an eighth transistor comprised in a second data writing device to be turned on by a third scanning signal input by the third scanning signal terminal, and writing a second data signal of the second data signal terminal into the fourth node, wherein a potential of the fourth node is n4=Vdata2, a seventh transistor comprised in a driving device is turned on, and the light emitting adjustment device comprises the second data writing device, the driving device, a storage device and a second light emitting control device;

wherein ref1 is the first initialization signal, VDD is a first power signal, $V_{th}$(M1) is a threshold voltage of the first transistor comprised in the first threshold compensation device, data1 is the first data signal and data2 is the second data signal.

19. The driving method of claim 16, wherein:

the fifth stage comprises: adjusting the potential of the first node to keep a first transistor comprised in the first threshold compensation device being turned off by a light emitting duration control signal input by the light emitting duration control signal terminal, controlling a ninth transistor comprised in a second light emitting control device to be turned on by a second light emitting control signal input by the second light emitting control signal terminal, and outputting a driving signal by a second electrode of a seventh transistor comprised in a driving device, wherein the light emitting adjustment device comprises a second data writing device, the driving device, a storage device and the second light emitting control device; and the sixth stage comprises: controlling a sixth transistor comprised in the first light emitting control device to be turned on by a first light emitting control signal input by the first light emitting control signal terminal, and adjusting the potential of the first node to control the first transistor comprised in the first threshold compensation device to be turned on by the light emitting duration control signal input by the light emitting duration control signal terminal; wherein a potential of the fourth node is n4=VDD, and the seventh transistor comprised in the driving device is turned off;

wherein VDD is a first power signal.

* * * * *